US008795052B2

(12) United States Patent
Shepherd et al.

(10) Patent No.: US 8,795,052 B2
(45) Date of Patent: Aug. 5, 2014

(54) STRATEGY GAME SYSTEMS AND METHODS

(76) Inventors: Steven Khajehnouri Shepherd, Brookline, MA (US); Allen Khajehnouri Shepherd, Quincy, MA (US)

( * ) Notice: Subject to any disclaimer, the term of this patent is extended or adjusted under 35 U.S.C. 154(b) by 142 days.

(21) Appl. No.: 13/468,754

(22) Filed: May 10, 2012

(65) Prior Publication Data

US 2013/0017873 A1 Jan. 17, 2013

Related U.S. Application Data

(60) Provisional application No. 61/506,642, filed on Jul. 12, 2011.

(51) Int. Cl.

| | |
|---|---|
| ***A63F 9/24*** | (2006.01) |
| ***A63D 15/00*** | (2006.01) |
| ***G06F 17/00*** | (2006.01) |
| ***G06F 19/00*** | (2011.01) |

(52) U.S. Cl.
USPC ..... 463/16; 273/236

(58) Field of Classification Search
USPC ..... 463/16; 273/236
See application file for complete search history.

(56) References Cited

U.S. PATENT DOCUMENTS

| | | | | |
|---|---|---|---|---|
| 4,306,724 A | | 12/1981 | Brzezinski et al. | |
| 4,688,802 A | | 8/1987 | Sandifer | |
| 5,395,118 A | | 3/1995 | Barrett | |
| 5,833,238 A | * | 11/1998 | Watanabe | 273/236 |
| 2003/0228908 A1 | * | 12/2003 | Caiafa et al. | 463/42 |
| 2010/0048276 A1 | * | 2/2010 | Wang | 463/14 |

FOREIGN PATENT DOCUMENTS

WO 8701298 A1 3/1987

OTHER PUBLICATIONS http://web.archive.org/web/20110404120604/http://www.di.fc.ul.pt/~jpn/gv/boards.htm.*

Written Opinion of the International Searching Authority, PCT/US2012/046307, mailed Jan. 30, 2013 (5 pages).

* cited by examiner

*Primary Examiner* — Omkar Deodhar
*Assistant Examiner* — Reginald Renwick
(74) *Attorney, Agent, or Firm* — Reza Mollaaghababa; Thomas J.. Engellenner; Pepper Hamilton LLP

(57) ABSTRACT

The present application relates to methods and systems for playing a strategy game in which two players take turns assigning a representative symbol to one or more locations of a playing field, with the ultimate goal being to own all (or most) of the playing field. In its most basic form, the playing field is defined by a plurality of nodes, each of which is directly connected to one or more adjacent nodes and indirectly connected to every other node of the playing field via a chain of adjacent nodes. After the current player assigns his symbol to a selected null node, it can be determined how the set of nodes owned by the current player partitions the set of nodes not owned by the current player into one or more transferable bounded sets. Ownership of the transferable bounded set(s) can then be transferred to the current player.

50 Claims, 14 Drawing Sheets

STRATEGY GAME SYSTEMS AND METHODS

RELATED APPLICATIONS

This application claims priority to U.S. Provisional Application Ser. No. 61/506,642 filed on Jul. 12, 2011, which is hereby incorporated by reference in its entirety.

FIELD

The present application generally relates to methods and systems for playing a game, and more particularly, to methods and systems for playing a strategy game in which two players take turns assigning values to one or more locations of a playing field in an attempt to capture most (or all) of the playing field.

INTRODUCTION

Strategy games have existed for centuries and remain a popular recreational activity across the world. For example, the game commonly referred to as "Go" in the United States was originally developed in China around 2500 years ago. In spite of (or possibly because of) its seemingly simple rules, "Go" has inspired many game enthusiasts with the vast number and depth of possible strategies. Nonetheless, a game of "Go" can become a tedious undertaking with sometimes limited spatial interaction between isolated territories at discrete portions of the board. Though a game of "Go" can end when the entire board has been filled with individually-placed stones, games more often end following a pre-determined number of moves or when both players resign, at which point the players must count their stones to determine who controls the most territory. Though other classic strategy games like checkers and chess provide a more definitive and readily apparent end (e.g., physical capture of an opponent's piece(s)), restrictive rules regarding the movement of game pieces can put a ceiling on strategy (as in checkers) or make it overly difficult for a newcomer to strategize beyond the mere mechanics of movement (as in chess).

Accordingly, there remains a need for an elegant strategy game having relatively simple rules and few limitations, while nonetheless allowing a player's decision-making and forethought regarding local action to readily and appreciably influence the game's global outcome.

SUMMARY

In accordance with one aspect of the present teachings, a method of playing a game is provided that includes defining a plurality of nodes, each of which can initially be a null node. The method can also include iteratively assigning a first symbol (which indicates ownership of a node by a first player) or a second symbol (which indicates ownership of a node by a second player) to at least one of the null nodes. The method can further include, subsequent to each assignment of the first or second symbol to at least one of the null nodes (and thereby indicating ownership by the current player), identifying one or more sets of null nodes or nodes owned by the other player, that are bounded by nodes owned by the current player ("bounded sets"), and transferring ownership of one or more transferable bounded sets, if any, to the current player.

In various aspects, transferring ownership of the one or more transferable bounded sets to the current player can include (i) assigning the symbol associated with the current player to each of the null nodes in the one or more transferable bounded sets, and (ii) for each of the nodes having the symbol associated with the other player in the one or more transferable bounded sets, changing said symbol to the symbol associated with the current player.

Identifying a bounded set, and whether the bounded set is transferable (i.e., whether it is to be transferred to the current player), can be performed in a variety of ways. In some aspects, for example, identifying one or more bounded sets and transferring ownership of one or more transferable bounded sets to the current player can include (i) selecting a node (herein "node z") not owned by the current player, (ii) determining a maximal connected set of nodes not owned by the current player containing said node z (herein "set B(z)"), (iii) determining a cardinality of the set B(z), (iv) determining a cardinality of a set of boundary nodes of the set B(z) (herein "set ∂B(z)"), and (v) if the cardinality of the set B(z) is less than one half of the total number of nodes, ownership of the nodes in the set B(z) can be transferred to the current player, or (vi) if a sum of the cardinality of the set B(z) plus the cardinality of the set ∂B(z) is greater than one half of the total number of nodes, ownership of nodes in a set complementary to the set B(z) and not owned by the current player can be transferred to the current player. In a related aspect, the method can further include iteratively selecting another node (herein "node z'") and repeating steps (ii)-(vi) for node z', wherein node z' is neither owned by the current player nor in the set B(z) or B(z') determined following the preceding selection of the node z or z'. In some aspects, the selection of another node z' can be terminated when there is no transfer of ownership to the current player in step (v) or (vi) following the preceding selection of the node z or z'. In one aspect, if the total number of nodes is odd, then under this exemplary rule for transferring ownership of a transferable bounded set, the game can end with a single player owning the entire set of nodes; if the total number of nodes is even, the game can end with each player owning exactly half of the nodes.

In various aspects, the plurality of nodes can be arranged according to a pattern. For example, the plurality of nodes can be arranged as a square grid. In a related aspect, the plurality of nodes can be bounded by a perimeter. In a related aspect, the square grid can represent a toroidal grid. In some aspects, each of the plurality of nodes can be adjacent four nodes. Alternatively, for example, each of the plurality of nodes can be adjacent six nodes. For example, each of nodes can be a hexagonal node.

In accordance with one aspect of the present teachings, a method of playing a game is provided that includes defining a plurality of nodes, each of which can initially be a null node, wherein a total number of nodes is W. The method can also include iteratively assigning ownership of the null nodes to a first and second player. The method further includes, subsequent to each assignment of a node or nodes to the current player, performing the following steps (i) selecting a node (herein "node z") not owned by the current player, (ii) identifying a maximal connected set containing said node z (herein "set B(z)"), and (iii) if a cardinality of the set B(z) is less than half of W, assigning to the current player any nodes in the set B(z) not owned by the current player, or (iv) if a cardinality of the set B(z) is equal to or greater than half of W, assigning to the current player any nodes in a complement set of the set B(z) not owned by current player. In some aspects, the method can include iteratively repeating steps (i)-(iv) until the performance of the steps results in no change in the number of nodes owned by the current player. In various embodiments, if the total number of nodes W is odd, then under this exemplary rule for transferring ownership of a transferable bounded set, the game can end with a single player owning the entire set of nodes; if the total number of nodes W is even, the game can end with each player owning exactly half of the nodes.

In various aspects, identifying the set B(z), herein generally referred to as the maximal connected set containing z, can include selecting a maximum number of nodes including z in which none of said maximum number of nodes is owned by the current player, and further, every node of said maximum number of nodes other than z, if any, is connected to z through a chain of adjacent nodes without including a node owned by the current player. Accordingly, every boundary node of the maximal connected set B(z) is owned by the current player.

In some embodiments, identifying the set B(z) can comprise: (a) selecting all nodes, if any, adjacent to the node z that are not owned by the current player to form a set $B_1(z)$ containing z and said selected nodes, (b) for k=2 to m, for each node in $B_{k-1}(z)$ (herein nodes $z_{k-1}$), selecting all nodes, if any, adjacent to each node $z_{k-1}$ that are not owned by the current player to form a set $B_k(z)$ containing nodes $z_{k-1}$ and said selected nodes, wherein m is an integer such that $B_m(z)$ is equal to $B_{m-1}(z)$, and thus, is identified as the set B(z). As a result, every boundary node of the maximal connected set B(z) is owned by the current player.

In some aspects, the set B(z) can correspond to a set having a number of nodes not owned by the current player and having a plurality of boundary nodes, where all of said boundary nodes are owned by the current player, and further, every node of B(z) other than z, if any, is connected to z through a chain of adjacent nodes without including a node owned by the current player.

In accordance with one aspect of the present teachings, a method of playing a game is provided that includes defining a set of nodes (herein "set W"), each of said nodes being initially a null node, wherein said set of nodes comprises a subset of nodes (herein "set P"). The method can further include iteratively assigning ownership of said null nodes to a first player and a second player, and subsequent to each assignment of a node(s) to a current player, performing the following steps: (i) selecting a node (herein "node z") not owned by the current player, (ii) identifying a maximal connected set (herein "set B(z)") containing the node z, and (iii) if a cardinality of a set corresponding to an intersection of the set B(z) and the set P is less than half of a cardinality of the set P, assigning to the current player any node in the set B(z) not owned by the current player, or (iv) if a cardinality of a set corresponding to an intersection of the set B(z) and the set P is equal to or greater than half of a cardinality of the set P, assigning to the current player any node in a complement set of the set B(z) not owned by the current player. In some aspects, the method can include iteratively repeating steps (i)-(iv) until the performance of these steps results in no change in the number of nodes owned by the current player. According to some aspects, if the total number of nodes in the subset P is odd, then under this exemplary rule, the game can end with a single player owning the entire set of nodes W; if the total number of nodes in subset P is even, the game can alternatively end with each player owning exactly half of the nodes in subset P. In some aspects, the subset of nodes P can comprise nodes on the perimeter of the plurality of nodes. In some other aspects, the subset of nodes P can comprise nodes inside a square grid nested in a larger square grid W. In general, P can be any pre-selected subset of W.

In various embodiments, identifying the set B(z) can include selecting a maximum number of nodes including z in which none of said maximum number of nodes is owned by the current player, and further, every node of said the maximum number of nodes other than z, if any, is connected to z through a chain of adjacent nodes without including a node owned by the current player. In some aspects, identifying the set B(z) comprises: (a) selecting all nodes, if any, adjacent to the node z that are not owned by the current player to form a set $B_1(z)$ containing z and said selected nodes, and (b) for k=2 to m, for each node in $B_{k-1}(z)$ (herein nodes $z_{k-1}$), selecting all nodes, if any, adjacent to each node $z_{k-1}$ that are not owned by the current player to form a set $B_k(z)$ containing nodes $z_{k-1}$ and said selected nodes, wherein m is an integer such that $B_m(z)$ is equal to $B_{m-1}(z)$, and thus, is identified as the set B(z). As a result, every boundary node of the maximal connected set B(z) can be owned by the current player.

In accordance with one aspect of the present teachings, a method of playing a game is provided that includes defining a set of nodes (herein "set W"), each of said nodes being initially a null node, associating with every node $n_i$ a predetermined number value $v_i$, defining a cardinality of a subset of W as the sum of the associated values of the nodes it contains, and iteratively assigning ownership of said null nodes to a first player and a second player. Subsequent to each assignment of a node(s) to a player ("current player"), the following steps can be performed: (i) defining a test set ($V_0$) as a set of nodes owned by the current player, (ii) for k=1 to m, iteratively performing the following steps: (a) if $V_{k-1}$ is not equal to W, selecting a node $z_k$ not contained in the set $V_{k-1}$, (b) identifying a maximal connected set $B_k(z)$ containing the node $z_k$, (c) defining a set $V_k$ as a union of $V_{k-1}$ and $B_k(z)$, wherein m is an integer such that $V_m$ is equal to W, (iii) if a cardinality of any maximal connected set $B_k(z)$ is less than half of a cardinality of W, assigning to the current player any nodes in the set $B_k(z)$ not owned by the current player. Steps (i) and (ii) together show how to partition the set of nodes not owned by current player into one of more maximal connected sets (or "bounded sets"), and step (iii) defines under this exemplary rule which maximal connected sets is to be transferred (i.e. is "transferable"). The node values $v_i$ can, for example, all be equal to 1 such that determining the cardinality of the maximal connected set $B_k(z)$ corresponds to counting all of the nodes of the bounded set, or for example, some of the nodes can have a pre-determined value 1, say in subset P, and other nodes can have value zero with a cardinality determined by the counter nodes of P. According to various aspects, if the cardinality of W is odd, then under this exemplary rule, the game can end with a single player (i.e., the last current player) owning the entire set of nodes W; if the cardinality of W is even, then the game can alternatively end with each player owning exactly half of the nodes.

In various aspects, identifying the set $B_k(z)$, herein generally referred to as the maximal connected set containing $z_k$, can include selecting a maximum number of nodes including $z_k$ in which none of said maximum number of nodes is owned by the current player, and further, every node of said maximum number of nodes other than $z_k$, if any, is connected to $z_k$ through a chain of adjacent nodes without including a node owned by the current player. As a result, every boundary node of the maximal connected set $B_k(z)$ is owned by the current player.

In some embodiments, identifying the set $B_k(z)$ can comprise: (a) selecting all nodes, if any, adjacent to the node $z_k$ that are not owned by the current player to form a set $B_k^1(z)$ containing $z_k$ and said selected nodes, (b) for j=2 to m, for each node in $B_k^{j-1}(z)$ (herein nodes $z_k^{j-1}$), selecting all nodes, if any, adjacent to each node $z_k^{j-1}$ that are not owned by the current player to form a set $B_k^j(z)$ containing nodes $z_k^{j-1}$ and said selected nodes, wherein m is an integer such that $B_k^m(z)$ is equal to $B_k^{m-1}(z)$, and thus, is identified as the set $B_k(z)$. As a result, every boundary node of the maximal connected set $B_k(z)$ is owned by the current player.

In some aspects, the set $B_k(z)$ can correspond to a set having a number of nodes not owned by the current player and having a plurality of boundary nodes, where all of said boundary nodes are owned by the current player, and further, every node of $B_k(z)$ other than $z_k$, if any, is connected to $z_k$ through a chain of adjacent nodes without including a node owned by the current player.

In accordance with one aspect of the present teachings, a method of playing a game is provided that includes defining a set of nodes (herein "set W"), each of said nodes being initially a null node, and iteratively assigning ownership of said null nodes to a first player and a second player. Subsequent to each assignment of a node(s) to a player ("current player"), the following steps can be performed: (i) defining a test set ($V_0$) as a set of nodes owned by the current player, (ii) for k=1 to m, iteratively performing the following steps: (a) if $V_{k-1}$ is not equal to W, selecting a node $z_k$ not contained in the set $V_{k-1}$, (b) identifying a maximal connected set $B_k(z)$ containing the node $z_k$, (c) defining a set $V_k$ as a union of $V_{k-1}$ and $B_k(z)$, wherein m is an integer such that $V_m$ is equal to W, (iii) identifying among the maximal connected sets $B_k(z)$ the maximal connected set $B_{max}$ having a cardinality equal to or greater than a cardinality of any of the other maximal connected sets $B_k(z)$, and (iv) if a cardinality of $B_{max}$ is greater than a sum of cardinalities of the other maximal connected sets $B_k(z)$, assigning to the current player any node not in $B_{max}$ and not owned by the current player. In various aspects, the above-described steps (i) and (ii) together demonstrate partitioning the set of nodes not owned by current player into one or more maximal connected sets (or "bounded sets"), while steps (iii) and (iv) can be used to determine, which, if any, of the maximal connected sets is transferable.

In some aspects, the cardinality of any of the maximal connected sets $B_k(z)$ can be defined as the number of nodes in that set. Alternatively, in various embodiments, the cardinality of any of the maximal connected sets $B_k(z)$ can be defined as the sum of the number of null nodes in $B_k(z)$ and n times the number of nodes in $B_k(z)$ owned by the other player. For example, n can be equal to 2.

In accordance with one aspect of the present teachings, a method of playing a game is provided that includes defining a set of nodes (herein "set W"), each of said nodes being initially a null node, and iteratively assigning ownership of said null nodes to a first player and a second player. Subsequent to each assignment of a node to a player ("current player"), the following steps can be performed: (i) defining a test set ($V_0$) as a set of nodes owned by the current player, (ii) for k=1 to m, iteratively performing the following steps: (a) if $V_{k-1}$ is not equal to W, selecting a node $z_k$ not contained in the set $V_{k-1}$, (b) identifying a maximal connected set $B_k(z)$ containing the node $z_k$, (c) defining a set $V_k$ as a union of $V_{k-1}$ and $B_k(z)$, wherein m is an integer such that $V_m$ is equal to W, (iii) allowing the other player to select one of said $B_k(z)$ sets, and (iv) in response to the selection by the other player, assigning to the current player any node in any of said maximal connected sets, other than said selected $B_k(z)$ set, that is not owned by the current player. In various aspects, the above-described steps (i) and (ii) together demonstrate partitioning the set of nodes not owned by current player into one or more maximal connected sets (or "bounded sets"), while steps (iii) and (iv) can be used to determine, which, if any, of the maximal connected sets is transferable.

In accordance with one aspect of the teachings herein, a digital gaming system is provided that includes at least one user interface having a display for presenting a playing field comprising a plurality of nodes and at least two symbols for assigning ownership of each of said nodes to at least one of two players, said nodes being initialized as null nodes. The user interface can be configured to receive input indicative of assignment of the symbols to the null nodes. The digital gaming system can also include at least one processor in communication with the user interface, the processor being programmed to execute the following tasks in response to an input indicative of an assignment of one of the symbols to one of the null nodes by the current player: (A) identifying one or more sets of null nodes or nodes owned by the other player that are bounded by nodes owned by the current player ("bounded sets"), (B) transferring ownership of one or more transferable bounded sets to the current player by assigning the symbol associated with the current player to nodes within the one or more transferable bounded sets, and (C) updating the display of the playing field to indicate current status of said plurality of nodes.

In some aspects, the display can be a touch panel that allows input regarding assignment of said symbols to said null nodes to be provided via touching said panel. In some aspects, the touch panel can represent each node by a delineated area.

In various embodiments, the digital gaming system can comprise a plurality of user interfaces, each having a display for presenting the playing field. In a related aspect, a digital processing unit can be associated with each of the plurality of user interfaces. In some aspects, the processor is in communication with each of the plurality of user interfaces.

In various aspects, the at least one processor can be at least two digital processing units, each of which is in communication with one of the plurality of user interfaces. Further, the at least two digital processing units can be in communication with one another. For example, the at least two digital processing units can be in communication with one another via a wireless network or via the internet.

BRIEF DESCRIPTION OF THE DRAWINGS

The person skilled in the art will understand that the drawings, described below, are for illustration purposes only. The drawings are exemplary and are not intended to limit the scope of the teachings in any way.

DETAILED DESCRIPTION

The present application relates to methods and systems for playing a strategy game in which two players take turns assigning a representative symbol to one or more locations of a playing field, with the ultimate goal being to own all (or most) of the playing field. In its most basic form, the playing field can be defined by a plurality of nodes, each of which is directly connected to one or more adjacent nodes and indirectly connected to every other node of the playing field via a chain of adjacent nodes.

Figure 1:
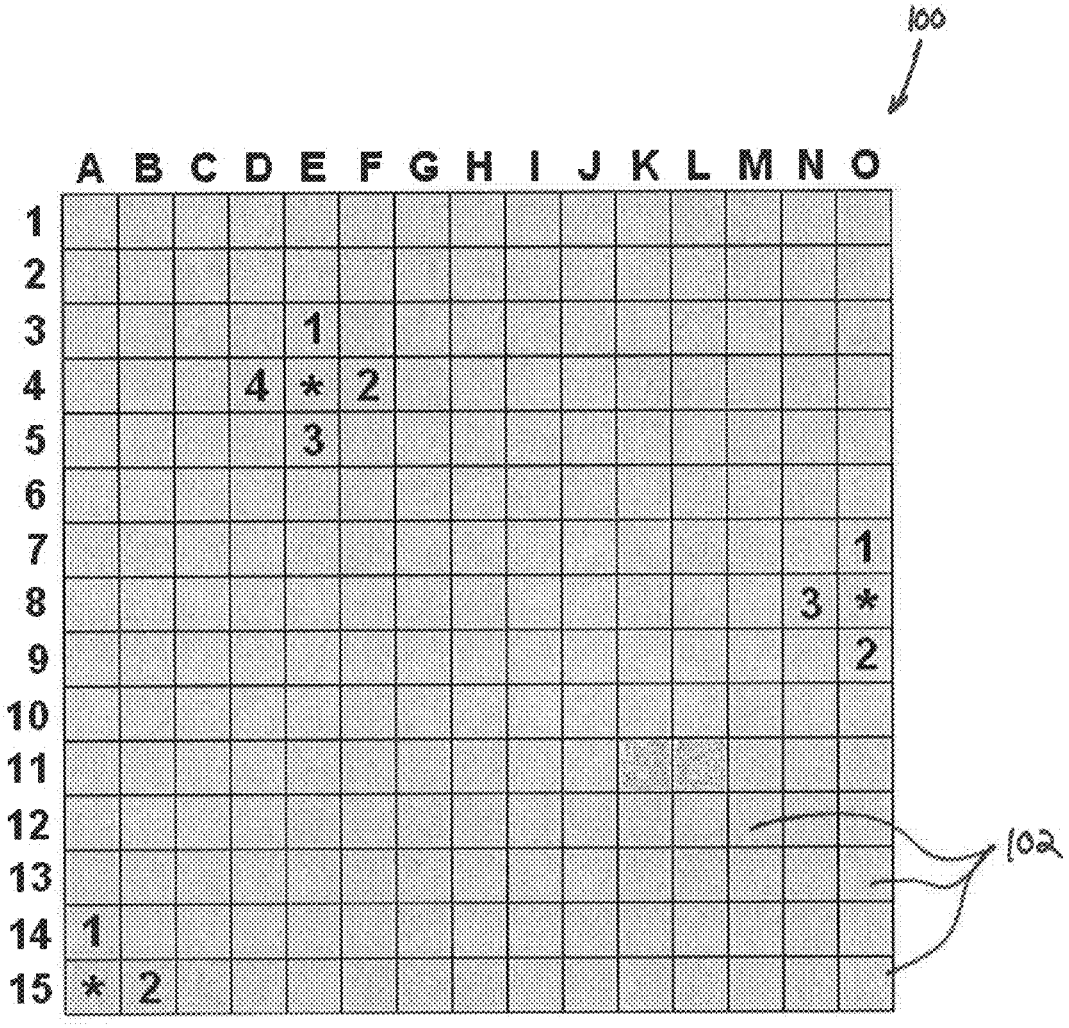
FIG. 1 depicts an exemplary playing field in accord with various aspects of the present teachings.

With reference now to FIG. 1, an exemplary playing field in accord with various aspects of the present teachings is depicted. As shown in FIG. 1, the playing field 100 contains a plurality of nodes 102 that are connected directly or indirectly to every other node of the playing field 100. Though playing fields in accord with the teachings herein can include any finite number of nodes of any shape, in this exemplary embodiment, the playing field 100 consists of 225 square nodes arranged as an array of 15 rows and 15 columns. Other exemplary playing fields include, by way of non-limiting example, a 9×9, 10×10, 11×11, 17×17, 19×19, 23×23, and 9×15 array of nodes.

As will be appreciated by a person skilled in the art, not only can playing fields for use in the methods and systems described herein include any number of interconnected nodes, but also the connectedness of the nodes can be defined in a variety of manners. By way of example, the playing field can be established at the beginning of each game by specifying which of the nodes are directly connected. For purposes of this application, nodes are considered to be "adjacent" to one another if the nodes are defined as being directly connected to one another. By way of example, and with reference still to FIG. 1, the plurality of nodes 102 can be defined such that each of the nodes 102, which in this embodiment are depicted as squares having four sides, are only considered directly connected to (i.e., adjacent to) those nodes with which it shares a side. For example, the node E4 shares a side with four nodes, and thus in this exemplary embodiment, is said to be adjacent to four nodes (E3, F4, E5, and D4). On the other hand, the edge node O8 shares a side with three nodes and is thus said to be adjacent to the nodes O7, O9, and N8 in this exemplary embodiment, while the corner node A15 shares a side with only two nodes and is thus said to be adjacent to the nodes A14 and B15 in this exemplary embodiment. As such, every node 102 of the exemplary playing field 100 is directly connected to two, three, or four nodes, and indirectly connected to every other node of the playing field 100 via a chain of nodes 102 that are directly connected to one another.

Though the nodes 102 of FIG. 1 are said to be directly connected to (i.e., adjacent to) only those nodes which share a common side, nodes can be defined to be directly connected to one another in a variety of manners and regardless of proximity or physical contact. By way of example, with reference now to FIG. 2, another exemplary playing field 200 is shown also having 225 square nodes arranged in an array of 15 rows and 15 columns. Unlike the nodes 102 of FIG. 1, however, the plurality of nodes 202 are defined such that each of the nodes 202 is considered to be directly connected to the nodes which share a common side as well as the nodes that are positioned diagonally up and to the left and diagonally down and to the right of the node as oriented in FIG. 2. Thus, in this exemplary embodiment, the node E4 is directly connected to (i.e., adjacent to) six nodes—the four nodes which share a common side (E3, F4, E5, and D4) and the two diagonal nodes (D3 and F5).

Figure 3:
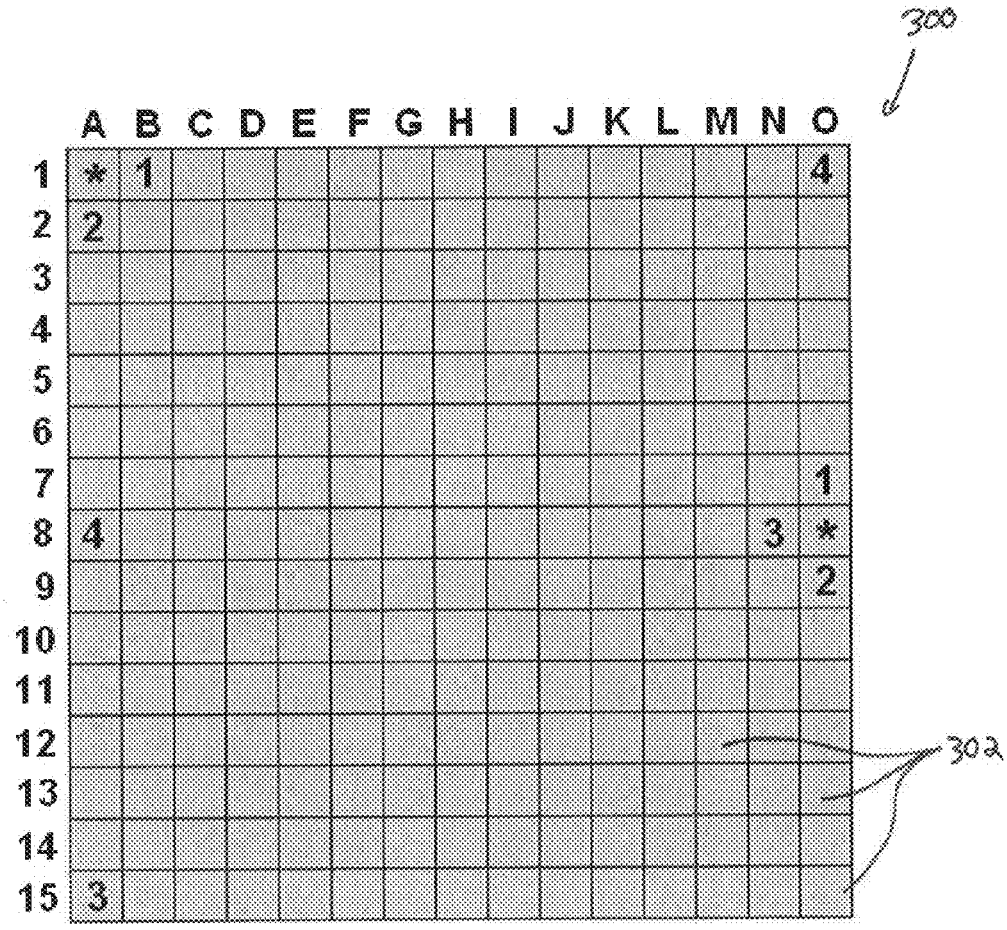
FIG. 3 depicts a third exemplary playing field in accord with various aspects of the present teachings.

With reference now to FIG. 3, another exemplary scheme for defining the connectedness of the nodes of a playing field is depicted. As in FIG. 1, the playing field 300 also includes 225 square nodes arranged in an array of 15 rows and 15 columns. However, unlike the playing field 100 of FIG. 1, every node 302 on the playing field is defined to be directly connected to exactly four other nodes. Whereas the edges of the playing field 100 of FIG. 1 represent a boundary such that nodes on these boundaries share a common side with less than four nodes, the playing field 300 is defined such that nodes on one edge are considered to be directly connected to nodes on the opposite edge. That is, the nodes A1, A2, A3 . . . A15 are directly connected to the nodes O1, O2, O3 . . . O15, respectively. Likewise, the nodes A1, B1, C1 . . . O1 are directly connected to the nodes A15, B15, C15 . . . O15, respectively. Thus, for example, as depicted in FIG. 3, the playing field 300 is defined such that the node A1 is adjacent to B1 and A2 as well as O1 and A15. Similarly, the node O8 is adjacent to O7, O9, N8, and A8.

Figure 2:
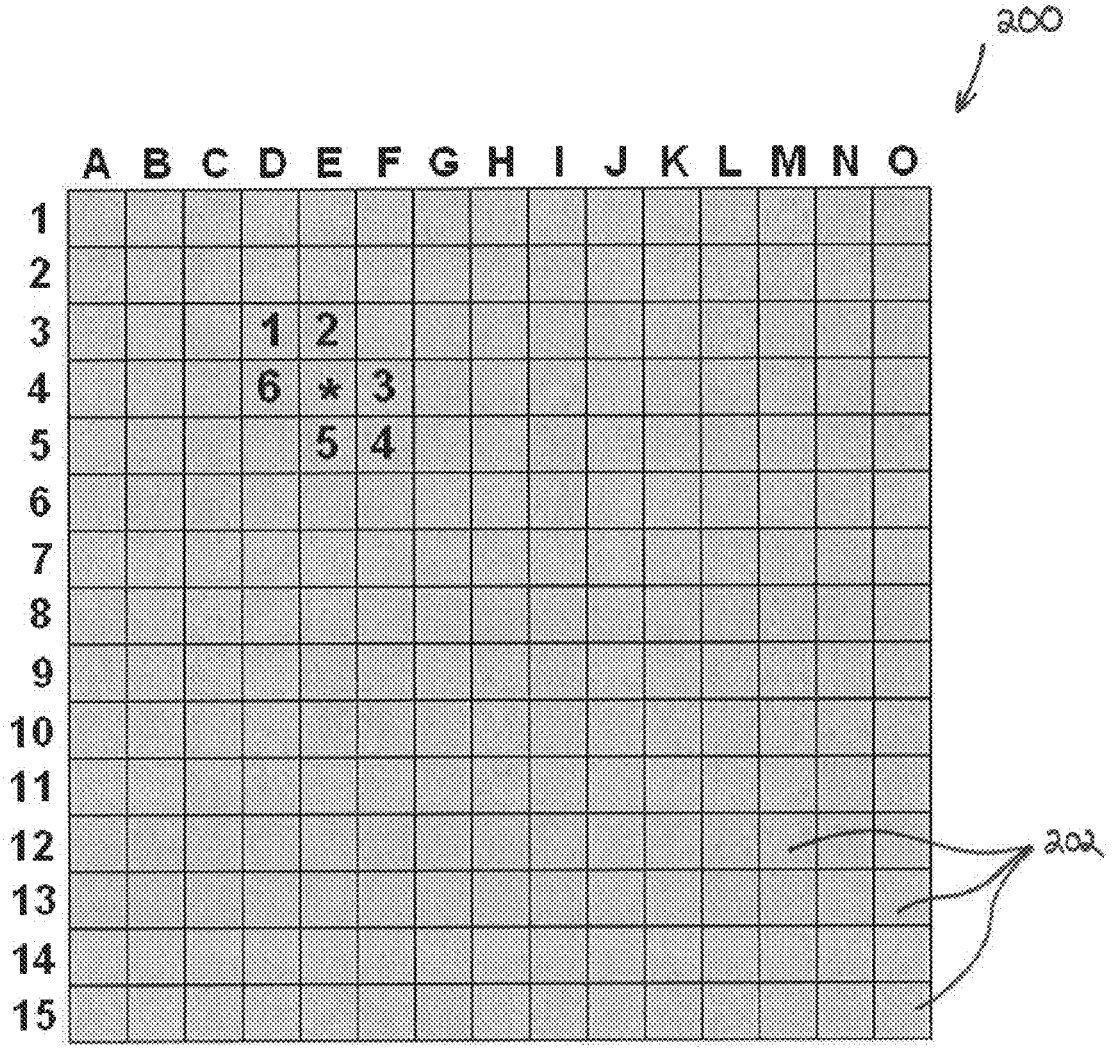
FIG. 2 depicts another exemplary playing field in accord with various aspects of the present teachings.
Figure 4:
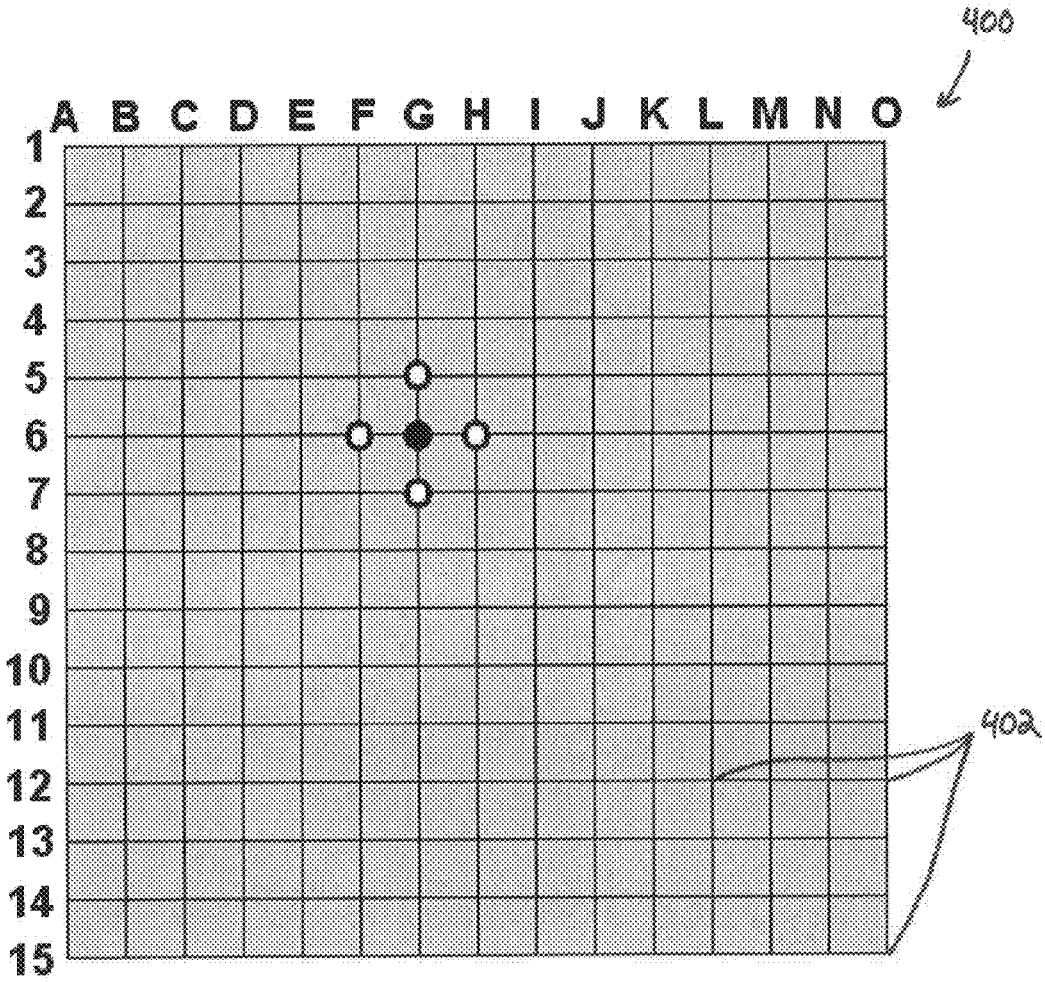
FIG. 4 depicts a fourth exemplary playing field in accord with various aspects of the present teachings.

Based on the above exemplary embodiments, one of skill in the art will appreciate that various other schemes can be used to define which of the plurality of nodes are directly connected to which of the other plurality of nodes. Moreover, a person skilled in the art will appreciate that the plurality of nodes can be represented in any variety of manners in accord with the teachings herein. For example, though the playing fields of FIGS. 1, 2, and 3 are depicted as a two-dimensional grid in which square grid elements represent the nodes, it will be appreciated that in various embodiments, the intersection of the gridlines themselves can represent the nodes. For example, with reference now to FIG. 4, another exemplary playing field 400 is depicted in which the grid includes 196 squares arranged in an array of 14 rows and 14 columns. Unlike in FIG. 1, however, the nodes 402 can be defined as the intersection of the gridlines, with each node being defined as directly connected to those nodes from which the intersecting gridlines extend. Thus, for example, the node represented by the closed circle (G6) is said to be directly connected to (i.e., adjacent to) the four nodes represented by the open circles (G5, H6, G7, and F6) in this exemplary embodiment.

Figure 5:
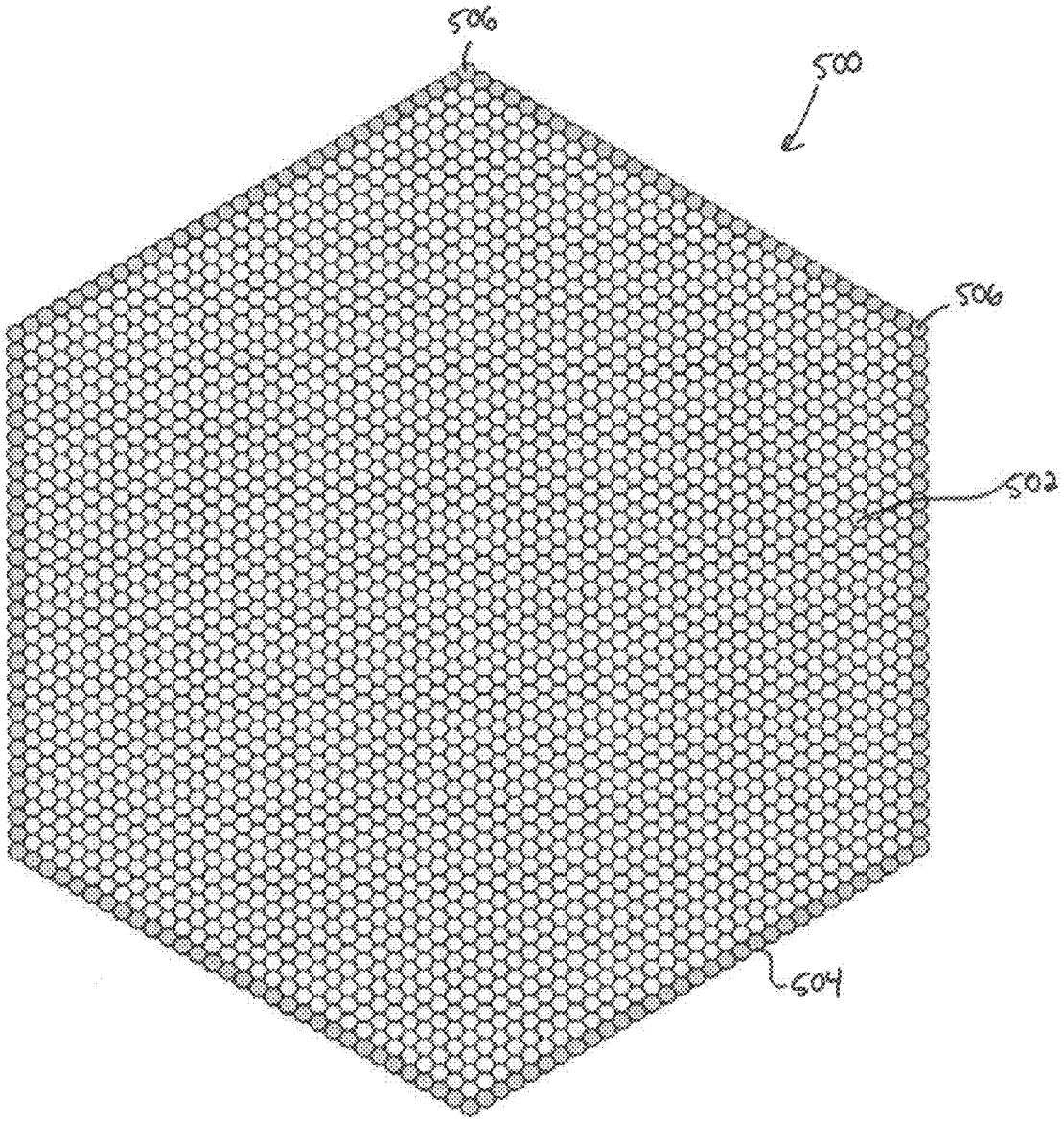
FIG. 5 depicts a fifth exemplary playing field in accord with various aspects of the present teachings.

In various embodiments, the playing field can have a variety of shapes and need not be defined by a square array of squares. For example, in one exemplary embodiment with reference now to FIG. 5, the hexagonal playing field 500 depicted in FIG. 5 comprises a plurality of circular nodes 502, each of which can be considered to be directly connected to (e.g., adjacent to) those nodes with which the node is in contact. As such, each of the central nodes 504 are directly connected to six nodes while the shaded boundary nodes 504 are directly connected to less than six nodes. For example, each of the corner nodes 506 are directly connected to three nodes, while the remainder of the boundary nodes 504 are directly connected to four nodes. A person skilled in the art will appreciate that the nodes, and the playing field as a whole, can have any variety of shapes. By way of example, the nodes can be shaped as a hexagon with the overall shape of the playing field being a rhombus. Alternatively, for example, the playing field can be triangular, with each node also being triangular.

A person skilled in the art will further appreciate that though the playing fields of FIGS. 1-5 are depicted as having identical nodes arranged in a two-dimensional pattern, playing fields in accord with the teachings herein need not be regular or two-dimensional. For example, in various embodiments, a playing field can be defined on the surface of a three-dimensional object (e.g., sphere), or indeed, the nodes themselves can be represented by a volume (e.g., each node can be a cube that can be directly connected up to six other nodes with which it shares a common side).

Once a playing field and the relationship (e.g., connectedness) between its nodes are defined, each of the plurality of nodes can be assigned a value indicating an initial state of the node. In various embodiments, each of the plurality of nodes can initially be considered a null node, indicating, for example, that the nodes are owned by neither player. The players can then take turns assigning their representative symbols to null node(s) to indicate that player's ownership of the selected node(s). By way of example, each player can take turns assigning their representative symbol to exactly one null node. Alternatively, for example, each player can assign their representative symbol to more than one null node per turn. The number of nodes (e.g., m) to be assigned by each player can vary on each turn or can be constant.

After each player (i.e., the current player) assigns his symbol to a selected null node(s), it can be determined whether the current player's nodes partition or bound one or more sets of nodes not owned by the current player (i.e., null nodes or nodes owned by the other player) that are to be transferred to the current player. For purposes of this application, a "bounded set" of nodes not owned by the current player comprises any node (generally referred to as 'node z') that is not owned by the current player and every other node, if any, not owned by the current player that can be connected to node z through a chain of adjacent nodes without including a node owned by the current player. As such, it is observed that at least one bounded set (generally referred to as B(z)) exists at any time before the end of the game as there always exists at least one node that is not the current player's nodes. By way of example, if every node not owned by the current player can be connected to one another through a chain of adjacent nodes without including a node owned by the current player, there exists exactly one bounded set. As will be discussed in detail below, after the one or more bounded sets are identified, various rules can be used to determine whether ownership of the nodes of a bounded set is to be transferred to a current player (i.e., whether said bounded set is "transferable"). In various embodiments, the transferrable bounded set(s) can then be transferred to the current player, for example, by assigning the symbol associated with the current player to each of the null nodes of the bounded set and by changing the symbol of nodes owned by the other player to the symbol associated with the current player.

Exemplary sequences of player moves will now be described to provide a clearer understanding of the present teachings. For ease of description, nodes belonging to the various players are depicted as black if owned by the black player and white if owned by the white player. Null nodes (i.e., those nodes owned by neither player) are depicted as gray.

With reference now to FIGS. 6A-6E, the exemplary playing field 100 depicted in FIG. 1 is shown with a game, according to various aspects of the present teachings, in progress. As discussed above, the playing field 100 consists of 225 square nodes arranged as an array of 15 rows and 15 columns, with each of the nodes 102 being defined in this particular example as being directly connected and thus "adjacent to" those nodes with which it shares a common side and indirectly connected to the remainder of the nodes 102 via a chain of adjacent nodes.

Figure 6A:
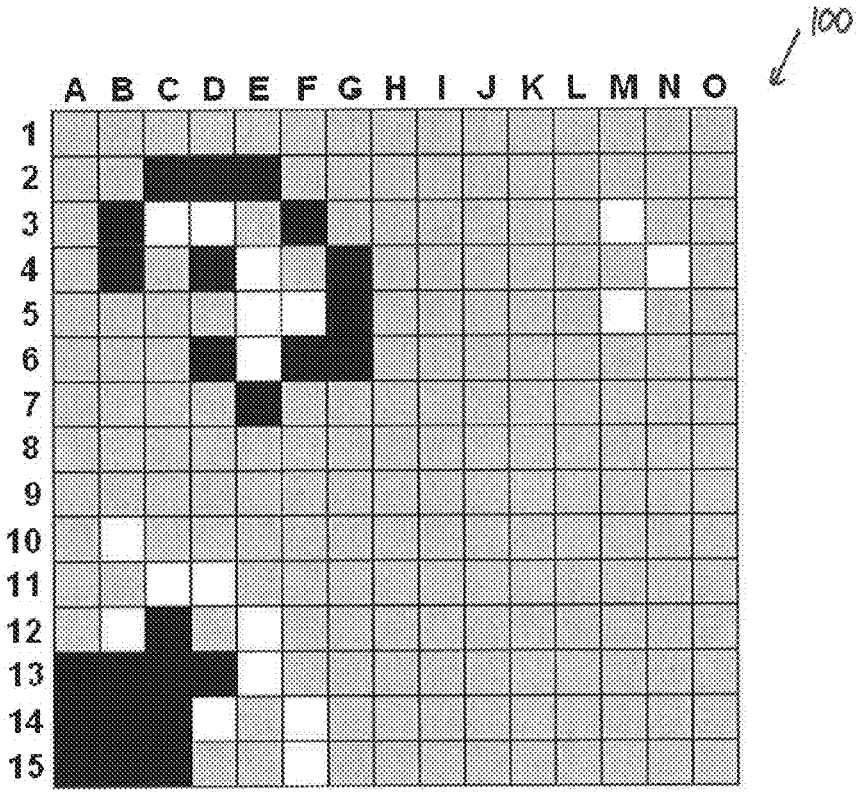
FIGS. 6A-E depict the playing field of FIG. 1 and demonstrate an exemplary sequence of selecting nodes and transferring of ownership of nodes of a transferable bounded set, in accord with various aspects of the present teachings.

With specific reference to FIG. 6A, at this moment in the game (this depicted configuration of the playing field can represent the nodes as initially defined or following one or more turns by the white and black players), the playing field 100 includes various nodes owned by the white player (B10, B12, C3, C11, D3, D11, D14, E4, E5, E6, E12, E13, F5, F14, F15, M3, M5, and N4) and various nodes owned by the black player (A13, A14, A15, B3, B4, B13, B14, B15, C2, C12, C13, C14, C15, D2, D4, D6, D13, E2, E7, F3, F6, G4, G5, and G6). The remaining nodes are null nodes and are owned by neither player. Assuming that the black player has just played, it is observed that there exists exactly one bounded set in FIG. 6A, namely, the set of all non-black nodes (null and white nodes), as every non-black node can be connected to the other non-black nodes through a chain of adjacent nodes without including a black node. Though various rules can be used to determine whether a bounded set is transferable, in the exemplary sequence depicted with reference to FIGS. 6A-E, a bounded set is said to be transferable only if the number of nodes in the bounded set is less than half of the total number of nodes of the playing field. Under this exemplary rule, the single bounded set comprising all of the non-black nodes would not be transferable as the number of nodes in this bounded set is greater than half of the total number of nodes.

Figure 6B:
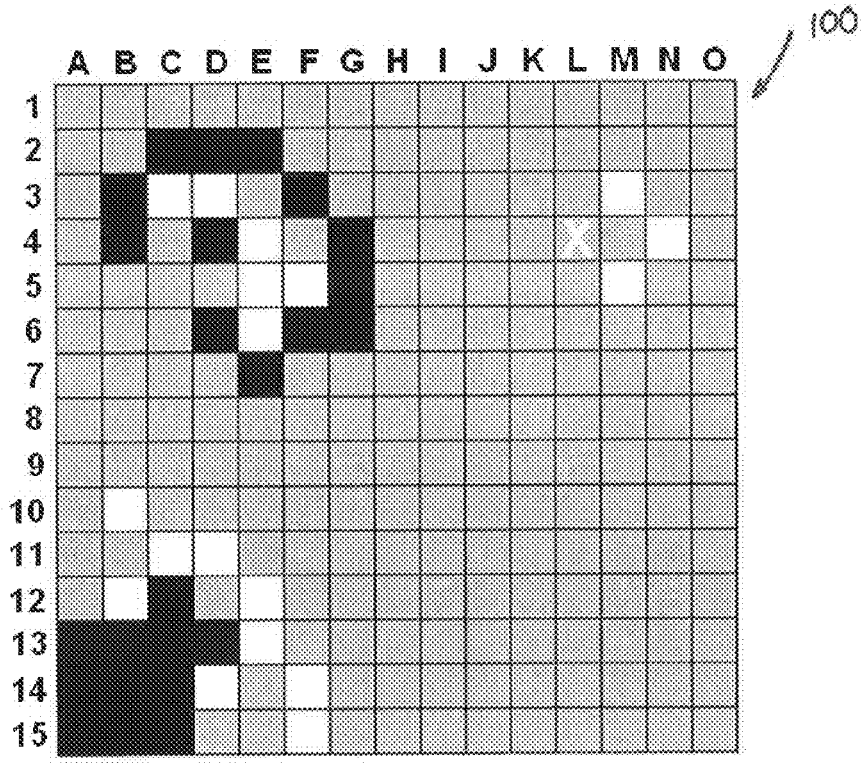

With reference now to FIG. 6B, at the commencement of the white player's turn, the white player elects to assign his symbol to the null node L4 as indicated by the white 'X,' thereby indicating ownership of that node by the white player.

After the current (i.e., white) player's assignment of the null node L4, it can be determined whether the white player's nodes bound one or more sets of non-white nodes that are to be transferred to the current player. As noted above, each "bounded set" of nodes not owned by the white player comprises any nodes not owned by the white player that can be connected to one another through a chain of adjacent nodes without including a white node. Thus, as shown in FIG. 6B, placement of the white 'X' at L4 is sufficient to form a bounded set having a single member {M4}. That is, the null node M4 alone forms a bounded set as the node M4 cannot be connected to any other black or null nodes through a chain of adjacent nodes without including a white node. A person skilled in the art will further appreciate that just as the white nodes L4, M3, M5, and N4 separate the "inside" bounded set {M4} from the remainder of the black and null nodes, the white nodes L4, M3, M5, and N4 likewise separate the "outside" black and null nodes from the "inside" null node M4. As such, the selection of L4 by the white player effectively generates two bounded sets (i.e., one bounded set comprising M4 and one bounded set comprising all of the other black and null nodes depicted in FIG. 6B).

Figure 6C:
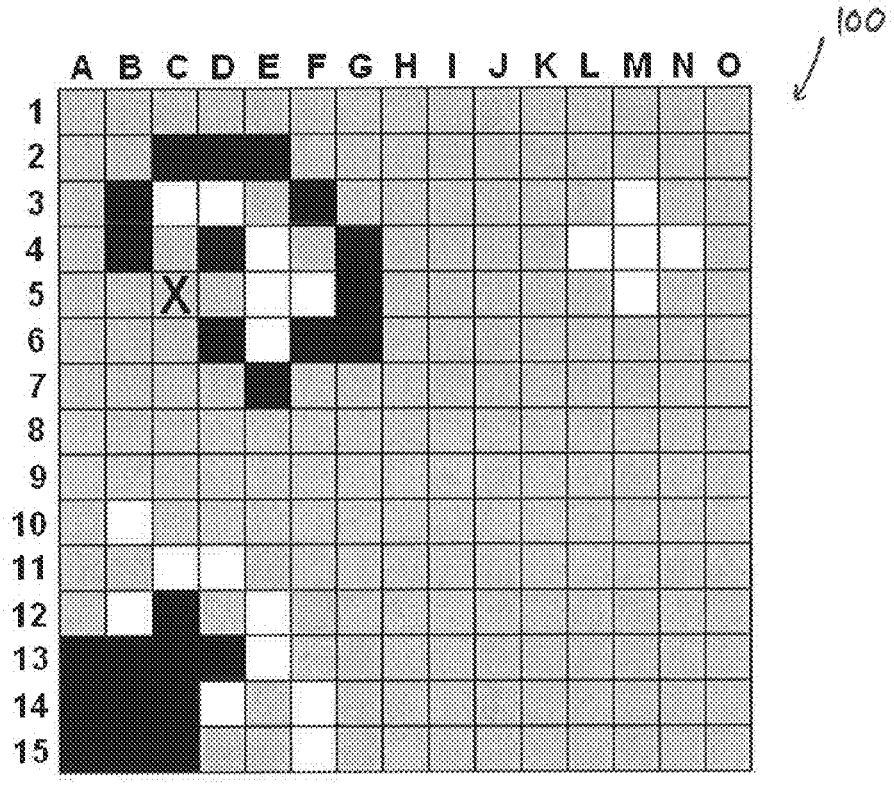

Accordingly, under the exemplary rule that a bounded set is transferable only if the number of nodes in the bounded set is less than half of the total number of nodes of the playing field, ownership of the "inside" bounded set having only a single node (M4) is transferred to white, while ownership of the "outside" bounded set, comprising the remaining black and null nodes (the number of which is greater than half of the total number of nodes in the playing field), remains unchanged as shown in FIG. 6C. In other words, the set of nodes not owned by the white player is partitioned into "inside" and "outside" bounded sets with the "inside"

bounded set being transferable and the "outside" bounded set not being transferable. A person skilled in the art will appreciate that though ownership of a bounded set can be transferred to the current player through a visual representation (e.g., such as assigning the null node M4 to white or in some cases changing the symbol of a black node to white and vice versa), the visual representation of the bounded nodes needs not be changed to indicate that the nodes are bounded by the current player's nodes.

With continued reference to FIG. 6C, it is now the black player's turn. In this exemplary sequence, the black player elects to assign his symbol to the null node C5 as indicated by the black 'X,' thereby indicating ownership of that node by the black player. After the black player's assignment, it can be determined whether the black player's nodes bound one or more sets of non-white nodes that are to be transferred to the current player. As shown in FIG. 6C, placement of the black 'X' at C5 is sufficient to partition the nodes not owned by the black player into an "inner" bounded set comprising several null or white nodes (C3, C4, D3, D5, E3, E4, E5, E6, F4, and F5), as these null or white nodes can be connected to one another through a chain of adjacent nodes without including a black node. It will also be appreciated that the black nodes B3, B4, C2, C5, D2, D6, E2, E7, F3, F6, G4, G5, or G6 form a boundary (i.e., partition) between the "inner" bounded set identified above and an "outer" bounded set comprising the remainder of the white and null nodes depicted in FIG. 6C. However, as depicted in FIG. 6D, only ownership of the "inner" bounded set would be transferred to the black player under the exemplary rule that a bounded set changes ownership only if the number of nodes in the bounded set is less than half of the total number of nodes of the playing field.

Figure 6D:
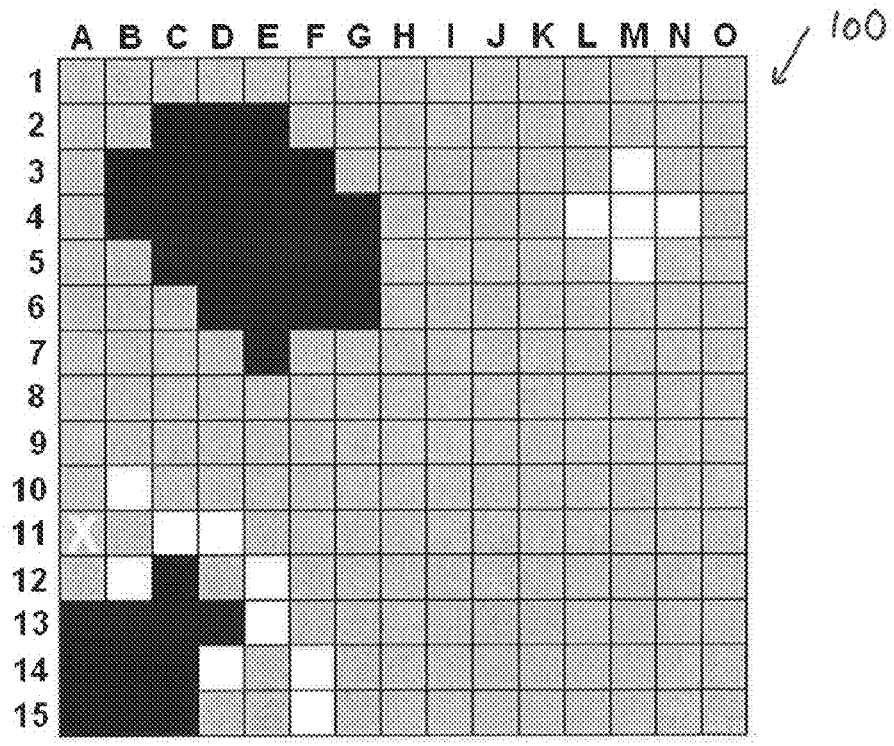
Figure 6E:
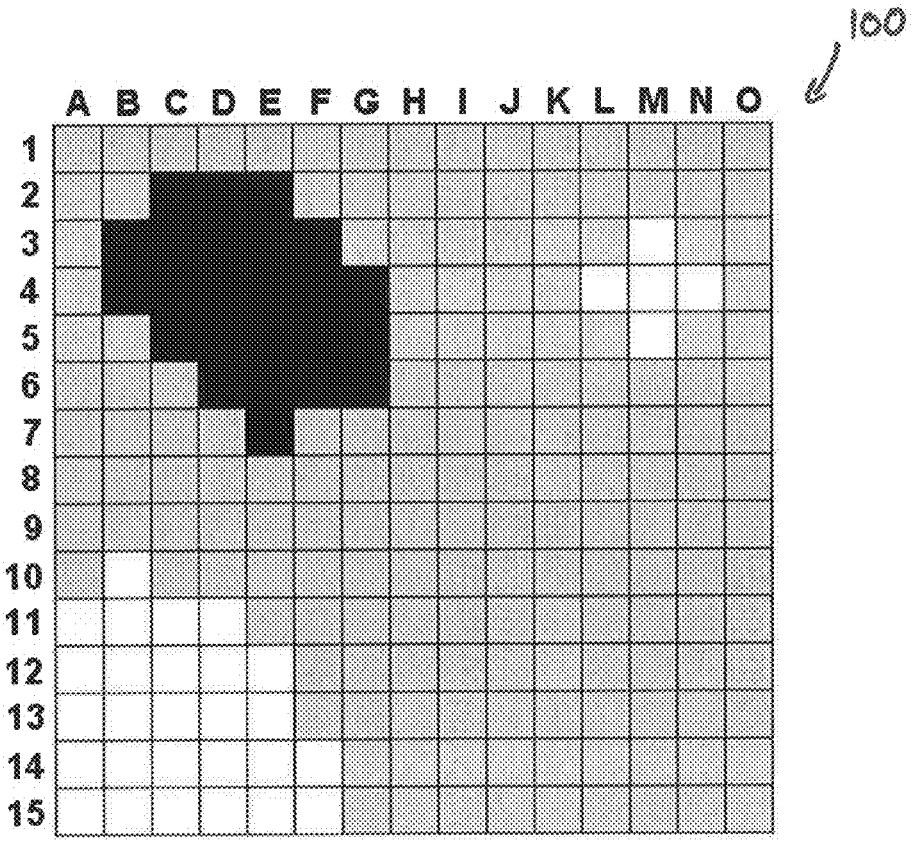

With reference still to FIG. 6D, the white player's turn is now used to assign the white symbol to the null node A11 as indicated by the white 'X'. The set(s) of non-white nodes (null and black nodes) that are bounded by white nodes can then be identified, as discussed above with reference to FIGS. 6B and 6C. Inspection of the playing field 100 depicted in FIG. 6D indicates that placement of the white 'X' at A11 is effective to partition the black and null nodes into three bounded sets: a first bounded set comprising the null node B11; a second bounded set comprising the null or black nodes A12, A13, A14, A15, B13, B14, B15, C12, C13, C14, C15, D12, D13, D15, E14, and E15; and a third bounded set comprising the remainder of the null and black nodes of the playing field depicted in FIG. 6D. Applying the exemplary rule that a bounded set is transferable, and thus, changes ownership only if the number of nodes in the bounded set is less than half of the total number of nodes of the playing field would thus result in the transfer of ownership of the first and second bounded sets identified above to result in the playing field as depicted in FIG. 6E. Under this exemplary rule, it can therefore be observed that at the end of the current player's turn at most one bounded set remains, with the game having ended in the case of no bounded set remaining.

Figure 7A:
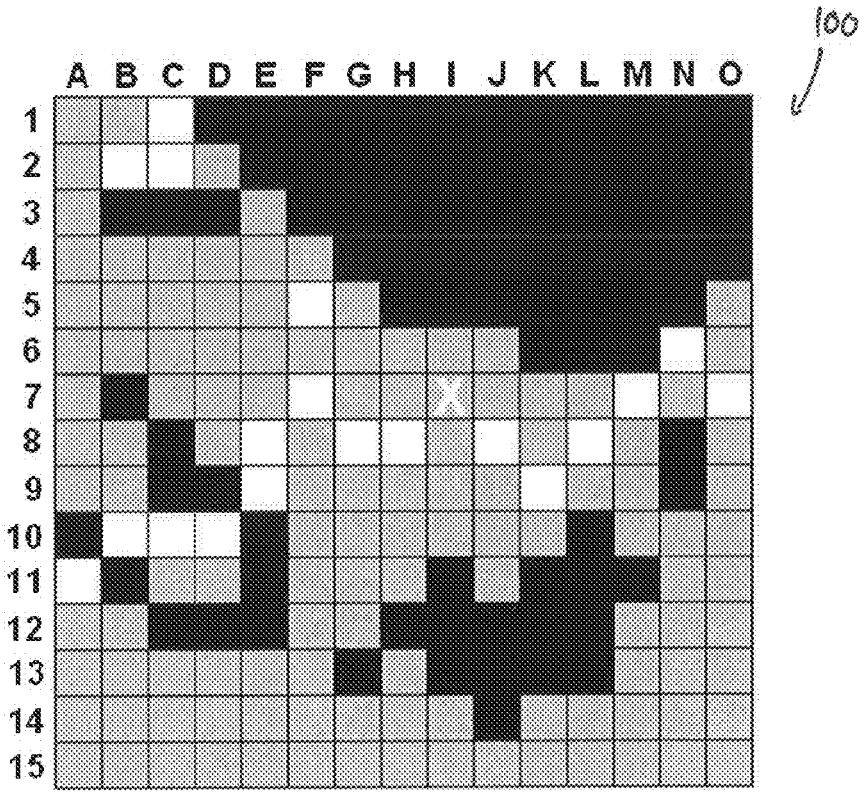
FIGS. 7A and 7B demonstrate another exemplary sequence of selecting a node and transferring of ownership of nodes of a transferable bounded set on the playing field of FIG. 1.
Figure 7B:
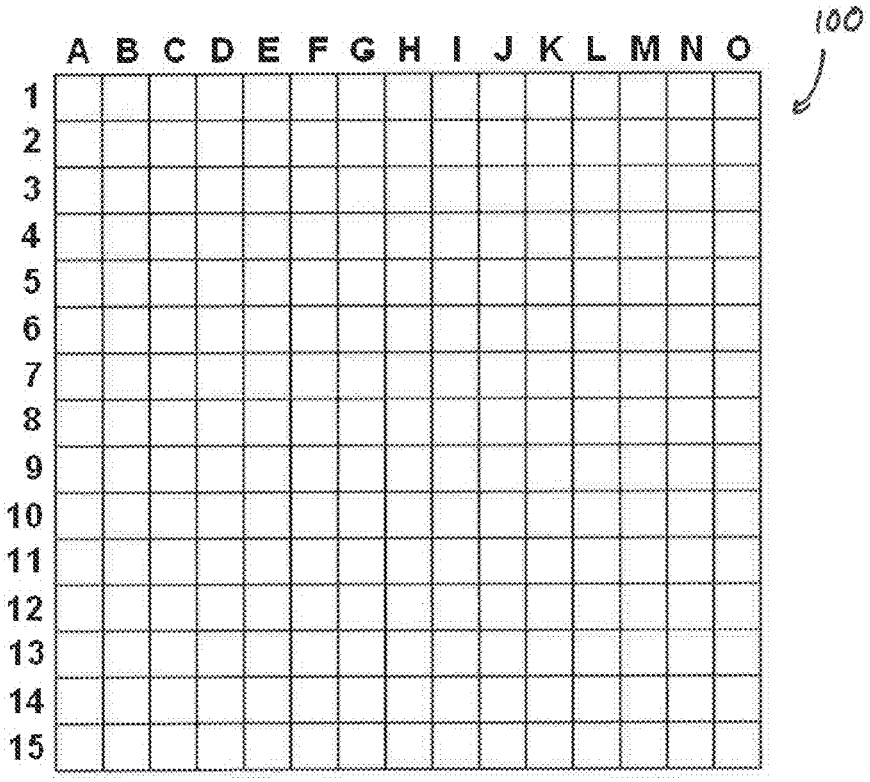

With reference now to FIGS. 7A and 7B, another exemplary sequence of player moves is shown on the exemplary playing field 100 of FIG. 1, with a game, according to various aspects of the present teachings, already in progress. As discussed above, the playing field 100 consists of 225 square nodes arranged as an array of 15 rows and 15 columns, with each of the nodes 102 being defined in this particular example as being directly connected and thus "adjacent to" those nodes with which it shares a common side.

With specific reference to FIG. 7A, at this moment in the game, the playing field 100 includes various nodes owned by the white player and various nodes owned by the black player. The remaining nodes are null nodes and are owned by neither player. At the white player's turn, the white player elects to assign his symbol to the null node 17 as indicated by the white 'X', thereby indicating ownership of that node by the white player. The set(s) of non-white nodes (null and black nodes) that are bounded by white nodes can then be identified, as discussed otherwise herein. Inspection of the playing field 100 depicted in FIG. 7A indicates that placement of the white 'X' at I7 is effective to generate what will be referred to as an "upper" bounded set and a "lower" bounded set for ease of description, with the white nodes A11, B10, C10, D10, E9, E8, F7, G8, H8, I7, J8, K9, L8, M7, N6, and O7 representing the boundary between the upper and lower bounded sets. That is, the null and black nodes above the boundary white nodes can be connected to one another through a chain of adjacent nodes without including a node owned by the current player. On the other hand, any chain of adjacent nodes connecting nodes of the upper bounded set to any of the nodes of the lower bounded set must necessarily include a boundary white node. Applying the exemplary rule discussed above with reference to the sequence of FIGS. 6A-6E would result in transferring ownership of both the upper and lower bounded sets to white (as shown in FIG. 7B), as the number of nodes in each of the upper and lower bounded sets is less than half of the total number of nodes of the playing field. At this point, it should be noted that under such an exemplary rule, if a playing field contains an odd number of nodes, a game generally ends with the entire playing field being owned by the player who last assigned his node to a null node. On the other hand, if the total number of nodes is even, a game can alternatively end with both players owning exactly half the total number of nodes.

Figure 8A:
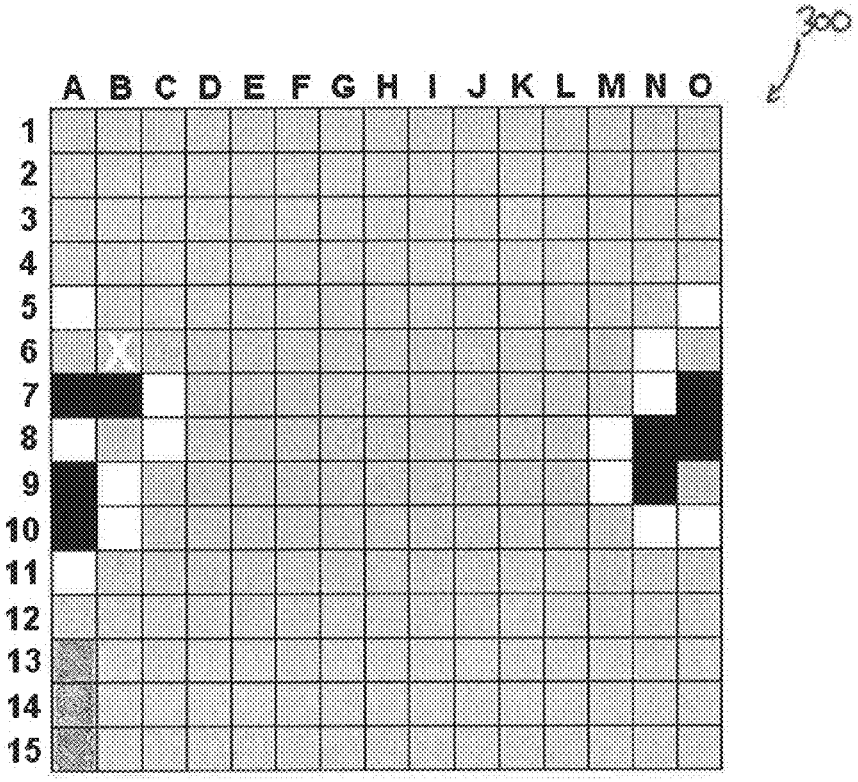
FIGS. 8A and 8B depict another exemplary playing field and the selection of a node and resultant transfer of ownership of nodes of a transferable bounded set, in accord with various aspects of the present teachings.
Figure 8B:
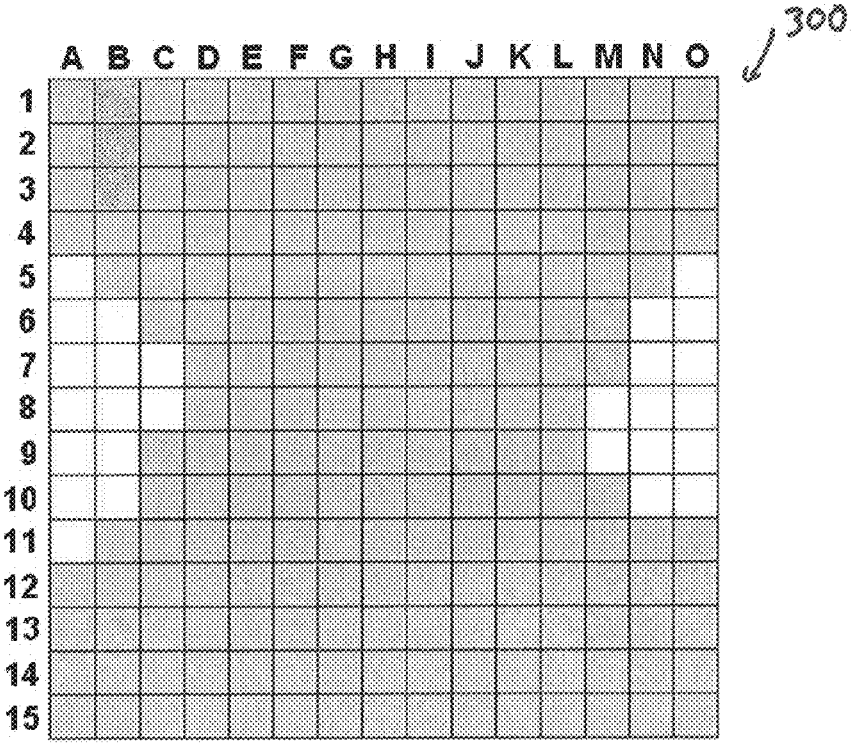

With reference now to FIGS. 8A and 8B, the exemplary playing field 300 depicted in FIG. 3 is shown with a game, according to various aspects of the present teachings, already in progress. As discussed above, the playing field 300 consists of 225 square nodes arranged as an array of 15 rows and 15 columns, with every node 302 being directly connected to (i.e., adjacent to) exactly four other nodes. In this exemplary playing field 300, for example, nodes on one edge are considered to be directly connected to respective nodes on the opposite edge.

With specific reference to FIG. 8A, at the moment in the game prior to placement of the white 'X' on the node B6, the playing field 300 includes various nodes owned by the white player (A5, A8, A11, B9, B10, C7, C8, M8, M9, N6, N7, N10, O5, and O10) and various nodes owned by the black player (A7, A9, A10, B7, N8, N9, O7, and O8). The remaining nodes are null nodes and are owned by neither player. As will be appreciated by a person skilled in the art in light of the teachings herein, because the nodes A1, A2, A3 . . . A15 are directly connected to the nodes O1, O2, O3 . . . O15, respectively, every one of the null and black nodes can be connected to every other null or black node of the playing field via a chain of adjacent nodes without including a white node such that there exists exactly one bounded set of non-white nodes. By way of example, the black node N9 can be connected to the black node A10 via a chain of adjacent nodes without including a white node (e.g., N9 is adjacent to O9, which is adjacent to A9, which is adjacent to A10). Similarly, the black node N9 can be connected to the null node A6 via a chain of adjacent nodes without including a white node (e.g., N9 is adjacent to N8, which is adjacent to O8, which is adjacent to O7, which is adjacent to O6, which is adjacent to A6). Upon placement of the white 'X' at B6, however, inspection of the playing field 300 depicted in FIG. 8A indicates that the set of nodes not owned by the white player have been partitioned into two bounded sets—a smaller bounded set spanning the edges of the playing field 300 and a larger bounded set comprising the remainder of the null nodes. By applying the exemplary rule applied above with reference to the sequence of FIGS. 6A-6E, ownership of the smaller bounded set would be transferred to white as depicted in FIG. 8B, as the number of nodes in the bounded set (i.e., A6, A7, A9, A10, B7, B8, N8, N9, O6, O7, O8, and O9) is less than half of the total number of nodes of the playing field.

Figure 9A:
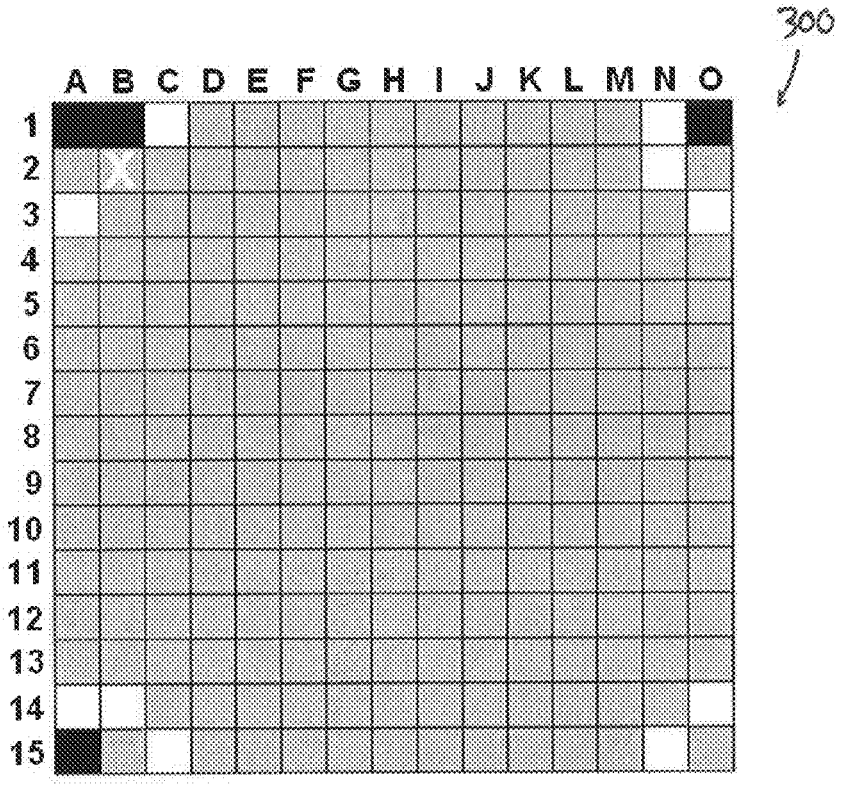
FIGS. 9A and 9B depict another exemplary playing field and the selection of a node and resultant transfer of ownership of nodes of a transferable bounded set, in accord with various aspects of the present teachings.
Figure 9B:
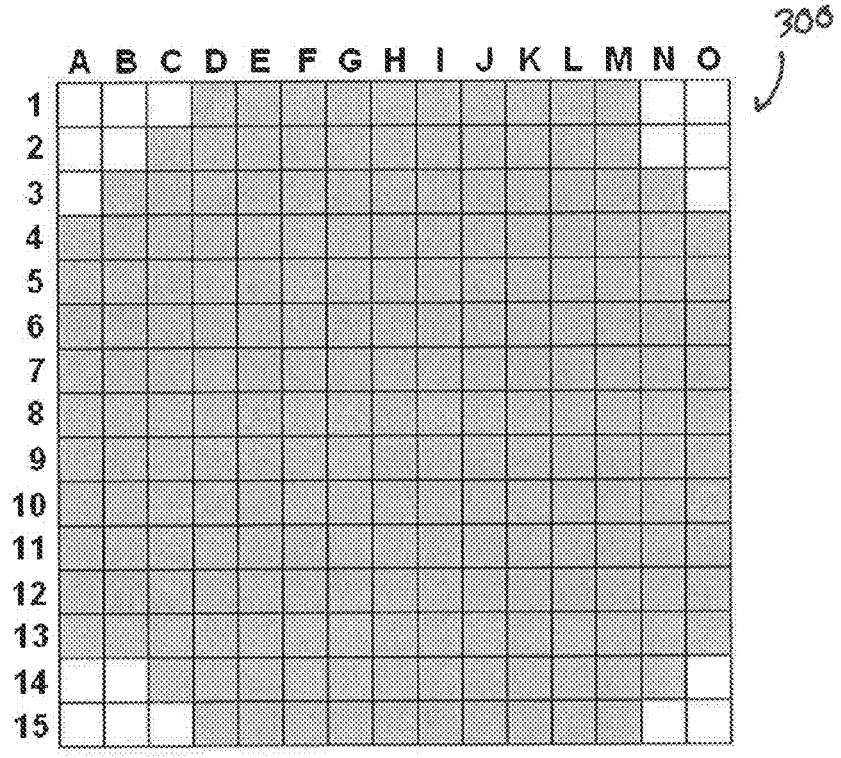

With reference now to FIGS. 9A and 9B, the exemplary playing field 300 depicted in FIG. 8 is shown with a different game from that of FIGS. 8A and 8B, according to various aspects of the present teachings, already in progress. With specific reference to FIG. 9A, at the moment in the game prior to placement of the white 'X' at B2, the playing field 300 includes various nodes owned by the white player (A3, A14, B14, C1, C15, N1, N2, N15, O3, and O14) and various nodes owned by the black player (A1, A15, B1, and O1). Because in this exemplary embodiment the nodes A1, A2, A3 . . . A15 are defined as being directly connected to the nodes O1, O2, O3 . . . O15, respectively, and the nodes A1, B1, C1 . . . O1 are directly connected to the nodes A15, B15, C15 . . . O15, respectively, the nodes A15 and B15, for example, can be connected to every other black or null node via a chain of adjacent nodes without including a white node. By way of example, the null node B15 can be connected to the null node O15 via one or more chains of adjacent nodes without including a white node (e.g., B15 is adjacent to A15, which is adjacent to O15) and can be connected to the null node O2 via one or more chains of adjacent nodes without including a white node (e.g., B15 is adjacent to A15, which is adjacent to O15, which is adjacent to O1, which is adjacent to O2). Upon placement of the white 'X' at B2, however, the "corner" null and black nodes form a bounded set that is isolated from the "central" null nodes by the boundary white nodes (A3, A14, B2, B14, C1, C15, N1, N2, N15, O3, and O14. Accordingly, by applying the exemplary rule applied above with reference to the sequence of FIGS. 8A and 8B, ownership of the smaller bounded set would be transferred to white because the number of nodes in the bounded set is less than half of the total number of nodes of the playing field.

While the above examples describe a rule in which a bounded set is transferred to the current player if the number of nodes in the bounded set is less than half of the total number of nodes of the playing field, one of skill in the art will appreciate that various other rules can be used for determining which, if any, of the identified bounded sets is to be transferred to the current player. For example, rather than comparing the number of nodes in a bounded set to the total number of nodes in the playing field, the size of two or more bounded sets can be compared to one another, with ownership being transferred, by way of non-limiting example, of the bounded set having the fewest number of bounded nodes therein. Alternatively, for example, after identifying the bounded set(s), ownership of the nodes not owned by the current player and that are not in the largest bounded set can be transferred to the current player if the cardinality of the cardinality of the largest bounded set is greater than a sum of cardinalities of the other bounded sets. Alternatively, in various embodiments, one of the players can elect one or more of the bounded sets to transfer to the current player or be reserved from being transferred to the current player.

Further, in some embodiments, a subset of the nodes of the playing field can be used to determine which, if any, of the bounded sets are transferable to the current player. For example, the playing field can be defined by a set of nodes (e.g., set W), with a subset (e.g., set P) of the nodes of set W being used as counter nodes. Once a current player's assignment generates one or more bounded sets, the number of counter nodes in each of the bounded sets can be compared to the total number of counter nodes, with ownership of a bounded set being transferred to the current player, for example, if the bounded set contains less counter nodes than half of the total number of counter nodes. Thus, even if only the counter nodes contained in the bounded set determine its size, the entire bounded set can be transferred to the current player if its size, for example, is less than half of the total number of counter nodes. By way of example, in playing fields such as that of FIG. 1 in which the perimeter nodes on one edge are not directly connected to perimeter nodes on the opposite edge, the perimeter nodes together can make up the set of counter nodes. As such, in some exemplary embodiments, a bounded set can be transferable if it contains less perimeter nodes than half of the total number of perimeter nodes. One of skill in the art will appreciate that the subset of counter nodes can comprise any number of the nodes in any patter, for example, a small square of node P within a bigger square W.

Alternatively, once a current player's assignment generates one or more bounded sets, the number of the counter nodes in each of the bounded sets can be compared to one another, with ownership being transferred to the current player, for example, of the bounded set having the fewest number of counter nodes. By way of example, in playing fields like that of FIG. 1 in which the perimeter nodes on one edge are not directly connected to perimeter nodes on the opposite edge, the perimeter nodes together can make up the set of counter nodes. As such, in some exemplary embodiments, the bounded set having the fewest number of perimeter nodes can be transferred to the current player.

More generally, prior to the start of the game, rather than each node having a unit value as in the case where cardinality is defined as the number of nodes in a set, or rather than every counter node of the subset P having a unit value and the other nodes having a null value, any node can have a pre-determined value, for example, from the set of non-negative numbers. In such an embodiment, the "less than half rule" as described otherwise herein, for example, can be applied with the cardinality of a bounded set being determined by the sum of the pre-determined values of the nodes it contains.

The above-described methods for playing a game can be implemented in a variety of manners. The game can be played, for example, as a table-top version in which the playing field comprises a physical object (e.g., a game board) onto which symbols indicative of a player are placed. For example, the game board can include a grid of pre-defined nodes onto which colored stones representing each player can be placed. Alternatively, in various embodiments, the playing field can be a continuous graph, for example, in which there are no pre-defined delineated nodes. Rather, a player can place a symbol, e.g., a disc filled with current player's "color," on an area of the continuous graph such that the symbol does not overlap any other previously-placed symbol. In such an embodiment, a current player's symbols can be said to bound an area of the graph if no symbol of the other player could move from the region within the current player's bounded area to a region outside or from the region outside the current player's bounded area to a region inside without overlapping the surrounding symbols of the current player. The bounded region can be transferred to the current player if, for example, it has less area than half of the area of the whole continuous graph.

Alternatively, the above-described methods and processes can be implemented in a digital gaming system having one or more modules for receiving, transmitting, processing, storing, generating, and/or displaying information about the playing field and the status of the nodes. In various embodiments, for example, digital gaming systems in accord with the teachings herein can include at least one user interface configured to display the playing field and at least one processor in communication with the user interface for determining the status of nodes of the playing field. For example, with reference now to FIG. 10A, an exemplary digital gaming system 1000 in accordance with the teachings herein can include, for example, two personal digital devices 1002*a,b* that can be in direct communication with one another. Each of the digital devices 1002*a,b* can include, for example, a user interface 1004 and at least one digital processor. By way of example, with reference now to FIG. 10B, in some embodiments each digital device 1002 can include a processor 1010 that communicates with the user interface 1004 and a memory unit 1012 via a bus 1014. The memory unit 1012 can store instructions for playing a strategy game in accordance with the present teachings, such as those discussed above. In this embodiment, the memory 1012 is a random access memory (RAM), which can receive the instructions for playing the game from a permanent storage unit 1018 under the control of the processor 1010. While in some embodiment, the permanent storage unit 1018 can be resident on each digital device 1002, in other embodiments, it can be remotely located, e.g., on a remote server that is in communication with the each digital device 1002. The processor 1010 can receive user input via the user interface 1004 and execute instructions stored in the memory 1012 in response to the user input.

Figure 10A:
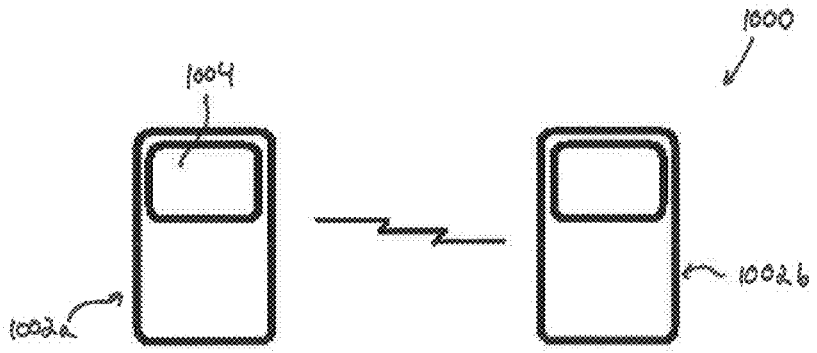
FIGS. 10A, 10B, and 10C depict exemplary embodiments of a digital gaming system in accord with various aspects of the present teachings.
Figure 10B:
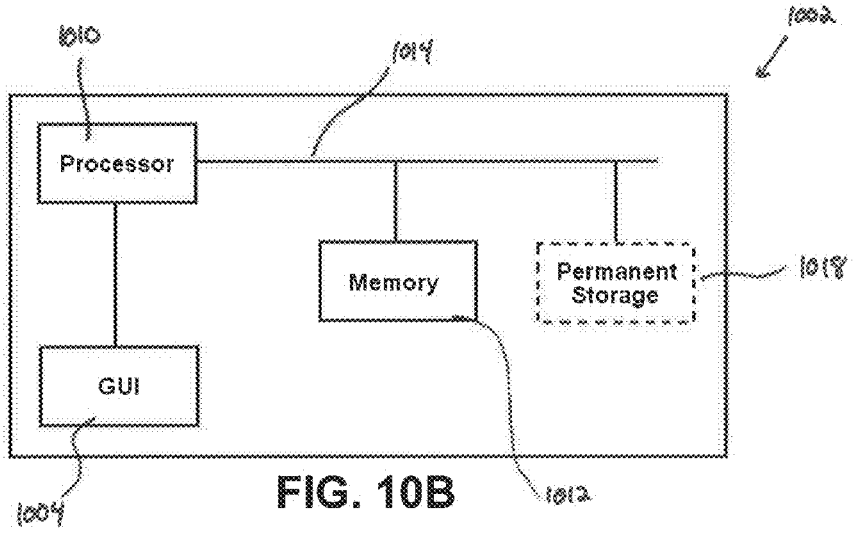
Figure 10C:
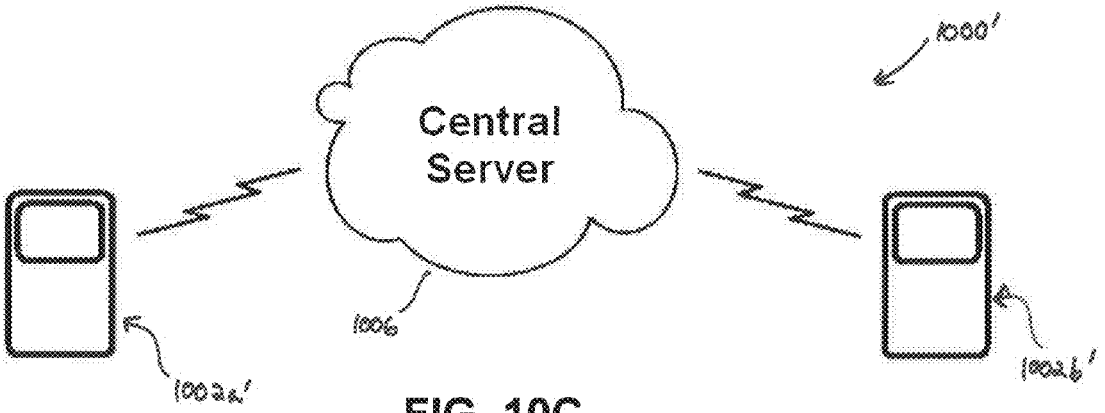

A person skilled in the art will further appreciate that the digital gaming system 1000 of FIGS. 10A and 10B is but one example of the architecture in which the methods otherwise described herein can be implemented, and that other configurations fall within the scope of the present teachings. For example, as shown in FIG. 10C, a system 1000' can allow for the transmission and exchange of content between any of the digital data devices 1002*a',b'* and a central server 1006. In such an embodiment, each of the digital data devices 1002*a',b'* can transmit, for example, a user's assignment of a node via the user interfaces 1004 to the central server 1006. Rather than each of the digital data devices 1002*a,b* having a processor for identifying the bounded set(s), transferring ownership of the bounded set(s), and/or updating the display of the playing field as described above with reference to FIG. 10A, the digital data processors 1002*a',b'* of FIG. 10C can communicate a user's selection of a node for assignment to a central server 1006 having a processor configured to identify the transferable bounded set(s) and update each of the displays on the player's digital data devices 1002*a',b'*.

As will be appreciated by a person skilled in the art, the one or more processor(s) of the digital gaming systems 1000, 1000' can be programmed to execute various tasks as otherwise described herein. A variety of programming languages, such as C++, Java™, Python, among others, can be employed in a manner known to those having ordinary skill in the art to program one or more processors of the exemplary digital gaming systems 1000, 1000' to execute various tasks for playing a strategy game in accordance with various aspects of the present teachings. By way of example, in response to an input indicative of an assignment of one of the player's symbols to a null node of the playing field, the processor can identify the one or more sets of nodes not owned by the current player that are bounded by nodes owned by the current player, transfer one or more transferable bounded sets, if any, and update the display to indicate ownership of the nodes of the transferable bounded set(s). The person skilled in the art will appreciate that the processor can be any of a variety of commercially available processors or computers, modified in accord with the teachings herein. By way of non-limiting example, any of a computer, laptop, personal data assistant (PDA), and smart phone can be configured according to the teachings herein. Moreover, the use of software, currently available or hereafter developed and modified in accord with the teachings herein, can be used to perform the methods and processes otherwise described herein.

The user interface can also have a variety of configurations but is generally configured to display the playing field and/or to receive input indicative of assignment of a player's symbol to nodes of the playing field. In some embodiments, for example, the user interface can be configured to allow the player to interact with (e.g., view, select, manipulate) the playing field. As will be appreciated by a person skilled in the art, the user interface can comprise a dedicated display device, for example, or alternatively, can be an integrated module within a player's digital data processor (e.g., an LCD screen on a smart phone). In various embodiments, for example, a player's digital data processor (e.g., any of a computer, laptop, personal data assistant (PDA), and smart phone) can include "widgets," "wizards," dedicated applications, or other special-purpose programs that can be executed by the user for providing the user interface.

Figure 11:
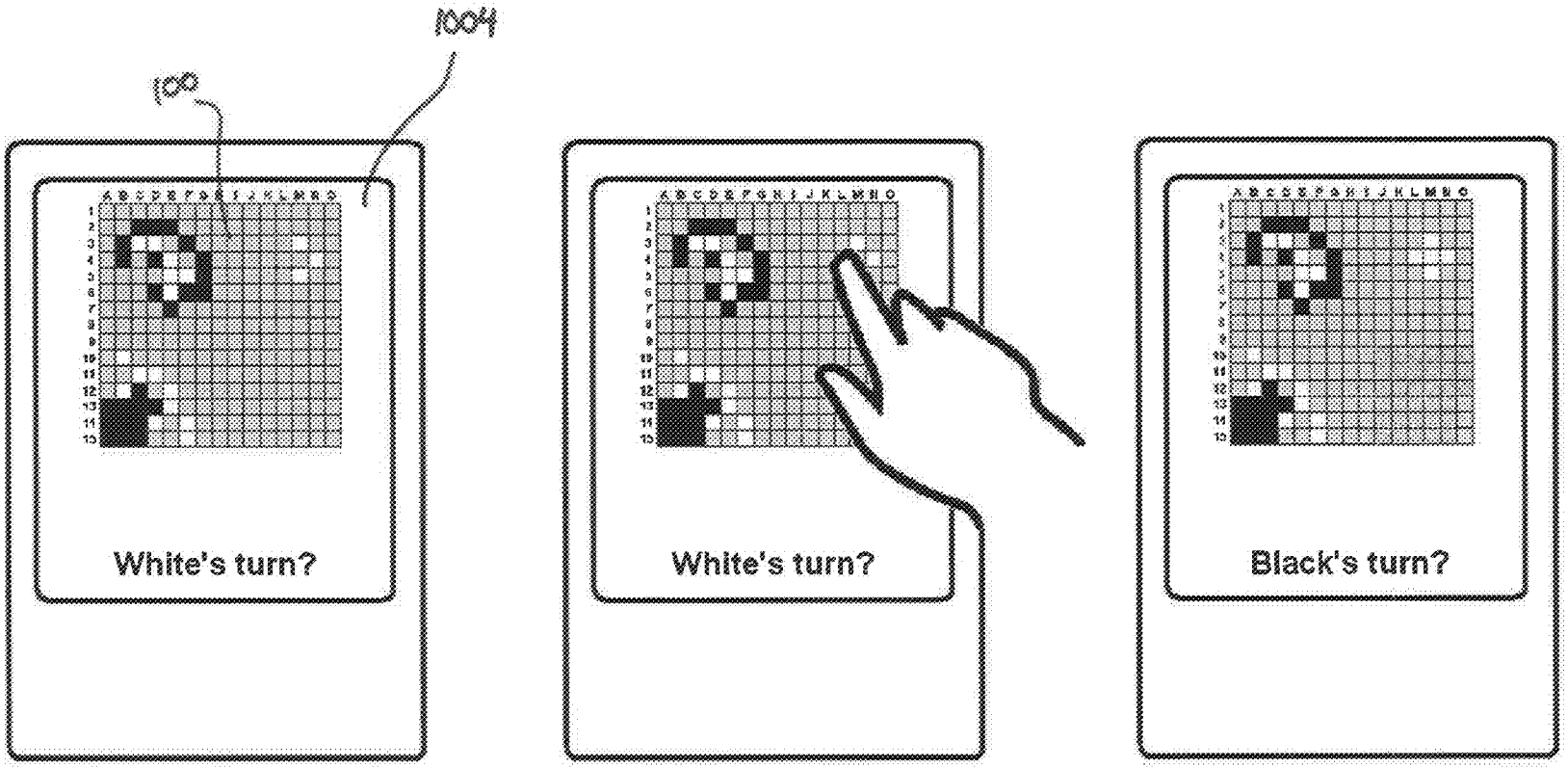
FIG. 11 depicts an exemplary embodiment of a user interface in accord with various aspects of the present teachings.
Figure 12:
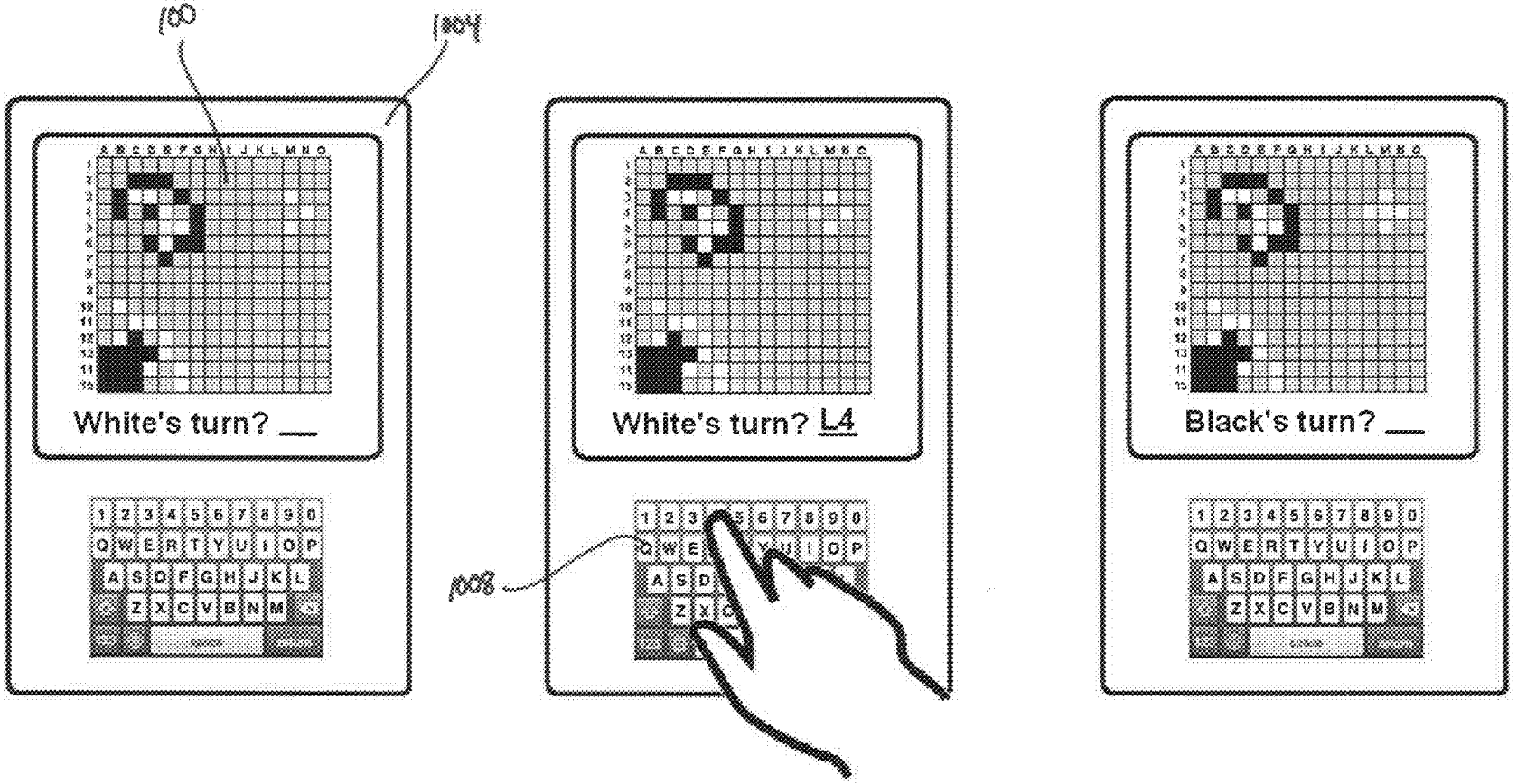
FIG. 12 depicts an exemplary embodiment of a user interface in accord with various aspects of the present teachings.

As shown in FIGS. 11 and 12, for example, exemplary user interfaces 1004 can display the playing field 100 and can prompt the current player to select a node. In some aspects, as shown in FIG. 11, for example, the display can be a touch panel that allows a player to input a selected null node by touching the panel. For example, the current player can touch the user interface at the location corresponding to a selected node. Alternatively, in some embodiments, the current player can input the location of an assigned node using a keyboard 1008 or other input device, for example, as shown in FIG. 12.

Referring again to FIGS. 10A-C, in various embodiments, the digital gaming system 1000, 1000' can include a plurality of user interfaces and/or a plurality of processors. By way of example, the processors can allow communication, e.g., wirelessly via Bluetooth or via the Internet, between the players' separate user interfaces so as to enable remote players to play against one another. As will be appreciated by the person skilled in the art, the processing can be performed on an individual player's device, or alternatively, a player's input (e.g., selection of a null node) can be transmitted from one player's user interface to a central processor that can be configured to record, store, or process the input to determine the status of the nodes of the playing field and update the players' user interfaces in communication therewith.

For example, in an exemplary embodiment, the digital gaming system can be implemented on a smart phone having a communication module capable of transmitting and receiving communication signals generated by an opponent's own smart phone via a wireless network or via the internet.

Operationally, once a player selects a node(s), e.g., through an input received by the user interface, the input can be transmitted to the digital data processor such that the processor can update the ownership status of the nodes of the playing field using any formula and/or algorithm known or hereafter developed in accord with the teachings herein. The at least one processor can process the data and/or information relating to the playing field and/or a player's selection to provide, for example, tables, graphs, scores, virtual images, video, plots, or other graphic or textual representations of the playing field on the user interface. For example, in the case of the toroidal playing field (e.g., a playing field in which the "edge" nodes are connected as in FIG. 3), a player may want to "center" any node by scrolling up, down, left, or right for easier visualization of the position.

By way of example, in response to the assignment of a null node by the current player, the one or more processors can identify and/or transfer to the current player one or more transferable bounded sets by performing an algorithm in which a test node not owned by the current player is selected (herein "node z"). The processor can determine a maximal connected set (herein "set B(z)") of nodes not owned by the current player containing node z. In some embodiments, the maximal connected set B(z) can include the maximum number of nodes in which none of the nodes are owned by the current player, and further, the maximum number of nodes can be connected to one another via a chain of adjacent nodes without including a node owned by the current player. After determining a cardinality of the set B(z) and a cardinality of a set of boundary nodes of the set B(z) (herein "set ∂B(z)"), the processor can transfer ownership of the nodes in the set B(z) to the current player if the cardinality of the set B(z) is less than one half of the total number of nodes. Alternatively, if a sum of the cardinality of the set B(z) and the cardinality of the set ∂B(z) is greater than one half of the total number of nodes, ownership of nodes in a set complementary to the set B(z) and not owned by the current player can be transferred to the current player. In some embodiments, the another test node (herein "node z'") can be selected (preferably node z' is neither owned by the current player nor in the set B(z) or B(z') determined following the preceding selection of the node z or z') and the above steps can be repeated until there is no further transfer of ownership of nodes to the current player following the preceding selection of the node z or z'.

In some embodiments, the processor can identify a maximal connected set B(z) for a test node z by performing an algorithm in which one or more nodes adjacent to the test node z that are not owned by the current player form a set $B_1(z)$ containing the node z and the selected adjacent nodes. The set $B_{k-1}(z)$ is expanded for k=2 to m, for each node in $B_{k-1}(z)$ (herein nodes $z_{k-1}$) by selecting one or more nodes that are adjacent to each node $z_{k-1}$ that are not owned by the current player to form a set $B_k(z)$ containing nodes $z_{k-1}$ and the selected adjacent nodes until $B_m(z)$ is equal to $B_{m-1}(z)$, wherein m is an integer, thereby defining B(z) as $B_m(z)$ when equal to $B_{m-1}(z)$.

In some embodiments, the one or more processors can identify and transfer to the current player one or more bounded sets by performing an algorithm in which a test set ($V_0$) of nodes owned by the current player is initially defined. For k=1 to m, the following steps can be iteratively performed: (a) if $V_{k-1}$ is not equal to W (i.e., the set of all nodes), a node $z_k$ not contained in the set $V_{k-1}$ can be selected, (b) a maximal connected set $B_k(z)$ associated with the node $z_k$ can be identified, and (c) the set $V_k$ can be defined as the union of $V_{k-1}$ and $B_k(z)$ wherein m is an integer such that $V_m$ is equal to W. Thereafter, if a cardinality of any maximal connected set $B_k(z)$ is less than half of a cardinality of W, assigning to the current player any nodes in the set $B_k(z)$ not owned by the current player.

In some embodiments, the one or more processors can identify and transfer to the current player one or more bounded sets by performing an algorithm in which a test set ($V_0$) of nodes owned by the current player is initially defined. For k=1 to m, the following steps can be iteratively performed: (a) if $V_{k-1}$ is not equal to W, the set of all nodes, a node $z_k$ not contained in the set $V_{k-1}$ can be selected, (b) a maximal connected set $B_k(z)$ associated with the node $z_k$ can be identified, and (c) the set $V_k$ as a union of $V_{k-1}$ and $B_k(z)$ can be defined, wherein m is an integer such that $V_m$ is equal to W. Thereafter, the maximal connected set ($B_{max}$) having a cardinality equal to or greater than a cardinality of any of the other maximal connected sets $B_k(z)$ can be identified and the nodes not in $B_{max}$ and not owned by the current player can be transferred to the current player if the cardinality of $B_{max}$ is greater than a sum of cardinalities of the other maximal connected sets. A person skilled in the art will appreciate that the cardinality of the $B_k(z)$ sets can be defined in a variety of manners. For example, cardinality can be defined as the number of nodes in a set, or alternatively, for example, as the sum of the number of null nodes in $B_k(z)$ and n times the number of nodes in $B_k(z)$ owned by the other player. As will be appreciated by a person skilled in the art, n can have a variety of values, for example, n can be equal to 2.

Alternatively, after identifying the maximal connected sets $B_k(z)$, for k=1 to m, wherein m is an integer such that $V_m$ is equal to W, the processor can prompt the other player to select one of the sets $B_k(z)$ of which the nodes will not be transferred to the current player. For example, in response to the selection of a set $B_k(z)$ by the other player, the processor can assign to the current player any node in any of the other maximal connected sets $B_k(z)$ that is not owned by the current player.

Any appended claims are incorporated by reference herein and are considered to represent part of the disclosure and detailed description of this patent application. Moreover, it should be understood that the features illustrated or described in connection with any exemplary embodiment may be combined with the features of any other embodiments. Such modifications and variations are intended to be within the scope of the present patent application. For example, a game may comprise of various choices made regarding: the number of assignments (m) by the current player per turn, the number values $v_i$ of nodes $n_i$ defining the notion of cardinality of sets of W, the manner in which the set (W) of nodes of the playing field are directly connected, and the transferability rule used to determine when a bounded set is to be transferred. By way of example, the following is a combination of choices that can be made to define a particular game: m=1, $v_i$=1 for all i, the playing field is a torus with every node having exactly 4 other nodes it is directly connected to, and the "less than half" rule defining transferability of bounded sets, obtaining, as a consequence of the "less than half" rule, the simple ending of the player who played last owning the whole playing field if the cardinality of W is odd.

What is claimed is:

1. A method of playing a game, comprising:

presenting a playing field on a user interface in communication with a processor, wherein said playing field comprises a plurality of nodes representing a square toroidal grid, and wherein each node is initially defined as a null node;

using said processor to iteratively assign a first or a second symbol to at least one of said null nodes, wherein said first symbol indicates ownership of a node by a first player and said second symbol indicates ownership of a node by a second player; and subsequent to each assignment of one of said first and second symbols to at least one of said null nodes to indicate ownership by said first or second player ("current player"), using said processor to identify one or more sets of null nodes or nodes owned by the other player that are bounded by nodes owned by the current player ("bounded sets"), and transferring ownership of one or more transferable bounded sets, if any, to the current player; and updating said playing field on said user interface to indicate the ownership status of the nodes.

2. The method of claim 1, wherein said step of transferring ownership of said one or more transferable bounded sets to the current player comprises:

(i) assigning the symbol associated with the current player to each of the null nodes in said one or more transferable bounded sets, and (ii) for each of the nodes having the symbol associated with the other player in said one or more transferable bounded sets, changing said symbol to the symbol associated with the current player.

3. The method of claim 1, wherein said plurality of nodes are arranged according to a pattern.

4. The method of claim 1, wherein each of said plurality of nodes is adjacent four nodes.

5. The method of claim 1, wherein each of said plurality of nodes is adjacent six nodes.

6. The method of claim 5, wherein said plurality of nodes are arranged as a hexagonal grid.

7. A method of playing a game, comprising:

presenting a playing field on a user interface in communication with a processor, wherein said playing field comprises a plurality of nodes wherein each node is initially defined as a null node;

using said processor to iteratively assign a first or a second symbol to at least one of said null nodes, wherein said first symbol indicates ownership of a node by a first player and said second symbol indicates ownership of a node by a second player; and subsequent to each assignment of one of said first and second symbols to at least one of said null nodes to indicate ownership by said first or second player ("current player"), using said processor to identify one or more sets of null nodes or nodes owned by the other player that are bounded by nodes owned by the current player ("bounded sets"), and transferring ownership of one or more transferable bounded sets, if any, to the current player; and updating said playing field on said user interface to indicate the ownership status of the nodes; and wherein the steps of identifying one or more bounded sets and transferring ownership of said one or more transferable bounded sets to the current player comprises:

(i) selecting a node (herein "node z") not owned by the current player, (ii) determining a maximal connected set of nodes not owned by the current player containing said node z (herein "set B(z)"), (iii) determining a cardinality of the set B(z), (iv) determining a cardinality of a set of boundary nodes of the set B(z) (herein "set ∂B(z)"), and (v) if said cardinality of the set B(z) is less than one half of the total number of nodes, transferring ownership of the nodes in the set B(z) to the current player, or (vi) if a sum of said cardinality of the set B(z) plus said cardinality of the set ∂B(z) is greater than one half of the total number of nodes, transferring ownership to the current player of nodes in a set complementary to the set B(z) and not owned by the current player.

8. The method of claim 7, further comprising iteratively selecting another node (herein "node z'") and repeating steps (ii)-(vi) for node z', wherein node z' is neither owned by the current player nor in the set B(z) or B(z') determined following the preceding selection of the node z or z'.

9. The method of claim 8, further comprising terminating the selection of another node z' when there is no transfer of ownership to the current player in step (v) or (vi) following the preceding selection of the node z or z'.

10. The method of claim 7, wherein said plurality of nodes are arranged as a square grid.

11. The method of claim 10, wherein said plurality of nodes are bounded by a perimeter.

12. The method of claim 10, wherein said square grid represents a toroidal grid.

13. A method of playing a game, comprising:

presenting a playing field on a user interface in communication with a processor, wherein said playing field comprises a plurality of nodes and wherein each node is initially a null node, and a total number of nodes is W;

using said processor to iteratively assign ownership of at least one of said null nodes to a first and a second player; and subsequent to each assignment of at least one of said null nodes to a player ("current player"), using said processor to execute the following steps:

(i) selecting a node (herein "node z") not owned by the current player, (ii) identifying a maximal connected set associated with said node z (herein "set B(z)"), and (iii) if a cardinality of the set B(z) is less than half of W, assigning to the current player any nodes in the set B(z) not owned by the current player, or (iv) if a cardinality of the set B(z) is equal to or greater than half of W, assigning to the current player any nodes in a complement set of the set B(z) not owned by current player; and, updating said playing field on said user interface to indicate the ownership status of the nodes.

14. The method of claim 13, further comprising iteratively repeating steps (i)-(iv) until the performance of said steps results in no change in the number of nodes owned by the current player.

15. The method of claim 13, wherein the step of assigning to the current player any nodes in the set B(z) not owned by the current player comprises:

for each null node in the set B(z), assigning said null node to the current player, and for each node in the set B(z) owned by the other player, changing ownership of that node to the current player.

16. The method of claim 13, wherein the step of identifying the set B(z) comprises selecting a maximum number of nodes including z in which none of said maximum number of nodes is owned by the current player, and further, every node of said maximum number of nodes other than z, if any, is connected to z through a chain of adjacent nodes without including a node owned by the current player.

17. The method of claim 13, wherein the step of identifying the set B(z) comprises:

(a) selecting all nodes, if any, adjacent to the node z that are not owned by the current player to form a set $B_1(z)$ containing z and said selected nodes, (b) for k=2 to m, for each node in $B_{k-1}(z)$ (herein nodes $z_{k-1}$), selecting all nodes, if any, adjacent to each node $z_{k-1}$ that are not owned by the current player to form a set $B_k(z)$ containing nodes $z_{k-1}$ and said selected nodes, wherein m is an integer such that $B_m(z)$ is equal to $B_{m-1}(z)$ is equal to B(z).

18. The method of claim 13, wherein the set B(z) corresponds to a set having a number of nodes not owned by the current player and having a plurality of boundary nodes, where all of said boundary nodes are owned by the current player, and further, every node of B(z) other than z, if any, is connected to z through a chain of adjacent nodes without including a node owned by the current player.

19. A method of playing a game, comprising:

presenting a playing field on a user interface in communication with a processor, wherein said playing field comprises a set of nodes (herein "set W"), and wherein each of said nodes is initially defined as a null node, wherein said set of nodes comprises a subset of nodes (herein "set P");

using said processor to iteratively assign ownership of at least one of said null nodes to a first player and a second player;

subsequent to each assignment of at least one of said null nodes to a player ("current player"), using said processor to execute the following steps:

(i) selecting a node (herein "node z") not owned by the current player, (ii) identifying a maximal connected set (herein "set B(z)") associated with said node z, and (iii) if a cardinality of a set corresponding to an intersection of the set B(z) and the set P is less than half of a cardinality of the set P, assigning to the current player any node in the set B(z) not owned by the current player, or (iv) if a cardinality of a set corresponding to an intersection of the set B(z) and the set P is equal to or greater than half of a cardinality of the set P, assigning to the current player any node in a complement set of the set B(z) not owned by the current player, and updating said playing field on said user interface to indicate the ownership status of the nodes.

20. The method claim 19, further comprising iteratively repeating steps (i)-(iv) until the performance of said steps results in no change in the number of nodes owned by the current player.

21. The method of claim 19, wherein the subset of nodes comprises nodes on the perimeter of the plurality of nodes.

22. The method of claim 19, wherein the step of assigning to the current player any node in the set B(z) not owned by the current player comprises:

for each null node in the set B(z), assigning said null node to the current player, and for each node in the set B(z) owned by the other player, changing ownership of that node to the current player.

23. The method of claim 19, wherein the step of identifying the set B(z) comprises selecting a maximum number of nodes including z in which none of said maximum number of nodes is owned by the current player, and further, every node of said maximum number of nodes other than z, if any, is connected to z through a chain of adjacent nodes without including a node owned by the current player.

24. The method of claim 19, wherein the step of identifying the set B(z) comprises:

(a) selecting all nodes, if any, adjacent to the node z that are not owned by the current player to form a set $B_1(z)$ containing z and said selected nodes, (b) for k=2 to m, for each node in $B_{k-1}(z)$ (herein nodes $z_{k-1}$), selecting all nodes, if any, adjacent to each node $z_{k-1}$ that are not owned by the current player to form a set $B_k(z)$ containing nodes $z_{k-1}$ and said selected nodes, wherein m is an integer such that $B_m(z)=B_{m-1}(z)=B(z)$.

25. The method of claim 19, wherein the maximal connected set B(z) corresponds to a set having a number of nodes not owned by the current player and having a plurality of boundary nodes, where all of said boundary nodes are owned by the current player, and further, every node of B(z) other than z, if any, is connected to z through a chain of adjacent nodes without including a node owned by the current player.

26. A method of playing a game, comprising:

presenting a playing field on a user interface in communication with a processor, wherein said playing field comprises a set of nodes (herein "set W"), and wherein each of said nodes is initially defined as a null node;

associating with every node $n_i$ a pre-determined number value $v_i$;

defining a cardinality of a subset of W as the sum of the associated values of the nodes it contains, using said processor to iteratively assign ownership of at least one of said null nodes to a first and a second player; and subsequent to each assignment of at least one of said null nodes to a player ("current player"), using said processor to execute the following steps:

(i) defining a test set ($V_0$) as a set of nodes owned by the current player, (ii) for k=1 to m, iteratively performing the following steps:

(a) if $V_{k-1}$ is not equal to W, selecting a node $z_k$ not contained in the set $V_{k-1}$, (b) identifying a maximal connected set $B_k(z)$ associated with the node $z_k$, (c) defining a set $V_k$ as a union of $V_{k-1}$ and $B_k(z)$, wherein m is an integer such that $V_m$ is equal to W, (iii) if a cardinality of any maximal connected set $B_k(z)$ is less than half of a cardinality of W, assigning to the current player any nodes in the set $B_k(z)$ not owned by the current player, and updating said playing field on said user interface to indicate the ownership status of the nodes.

27. The method of claim 26, wherein the step of identifying the maximal connected set $B_k(z)$ comprises selecting a maximum number of nodes including $z_k$ in which none of said maximum number of nodes is owned by the current player, and further, every node of said maximum number of nodes other than $z_k$, if any, is connected to $z_k$ through a chain of adjacent nodes without including a node owned by the current player.

28. The method of claim 26, wherein the step of identifying the set $B_k(z)$ comprises:

(a) selecting all nodes, if any, adjacent to the node $z_k$ that are not owned by the current player to form a set $B_k^1(z)$ containing $z_k$ and said selected nodes, (b) for j=2 to m, for each node in $B_k^{j-1}(z)$ (herein nodes $z_k^{j-1}$), selecting all nodes, if any, adjacent to each node $z_k^{j-1}$ that are not owned by the current player to form a set $B_k^J(z)$ containing nodes $z_k^{j-1}$ and said selected nodes, wherein m is an integer such that $B_k^m(z)$ is equal to $B_k^{m-1}(z)$ is equal to $B_k(z)$.

29. The method of claim 26, wherein any set $B_k(z)$ corresponds to a set having a number of nodes not owned by the current player and having a plurality of boundary nodes, where all of said boundary nodes are owned by the current player, and further, every node of $B_k(z)$ other than $z_k$, if any, is connected to $z_k$ through a chain of adjacent nodes without including a node owned by the current player.

30. A method of playing a game, comprising:

presenting a playing field on a user interface in communication with a processor, wherein said playing field comprises a set of nodes (herein "set W"), and wherein each of said nodes is initially defined as a null node;

using said processor to iteratively assign ownership of at least one of said null nodes to a first and a second player; and subsequent to each assignment of at least one of said null nodes to a player ("current player"), using said processor to execute the following steps:

(i) defining a test set ($V_0$) as a set of nodes owned by the current player, (ii) for k=1 to m, iteratively performing the following steps:

(a) if $V_{k-1}$ is not equal to W, selecting a node $z_k$ not contained in the set $V_{k-1}$, (b) identifying a maximal connected set $B_k(z)$ associated with the node $z_k$, (c) defining a set $V_k$ as a union of $V_{k-1}$ and $B_k(z)$, wherein m is an integer such that $V_m$ is equal to W, (iii) identifying among the maximal connected sets $B_k(z)$ the set $B_{max}$ having a cardinality equal to or greater than a cardinality of any of the other maximal connected sets, and (iv) if a cardinality of $B_{max}$ is greater than a sum of cardinalities of the other maximal connected sets $B_k(z)$, assigning to the current player any node not in $B_{max}$ and not owned by the current player, and updating said playing field on said user interface to indicate the ownership status of the nodes.

31. The method of claim 30, wherein the cardinality of any of the maximal connected sets $B_k(z)$ is defined as the number of nodes in that set.

32. The method of claim 30, wherein the cardinality of any of the maximal connected sets $B_k(z)$ is defined as the sum of the number of null nodes in $B_k(z)$ and n times the number of nodes in $B_k(z)$ owned by the other player.

33. The method of claim 32, wherein n=2.

34. A method of playing a game, comprising:

presenting a playing field on a user interface in communication with a processor, wherein said playing field comprises a set of nodes (herein "set W"), and wherein each of said nodes is initially defined as a null node;

using said processor to iteratively assign ownership of at least one of said null nodes to a first and a second player; and subsequent to each assignment of at least one of said null nodes to a player ("current player"), using said processor to execute the following steps:

(i) defining a test set ($V_0$) as a set of nodes owned by the current player, (ii) for k=1 to m, iteratively performing the following steps:

(a) if $V_{k-1}$ is not equal to W, selecting a node $z_k$ not contained in the set $V_{k-1}$, (b) identifying a maximal connected set $B_k(z)$ associated with the node $z_k$ (c) defining a set $V_k$ as a union of $V_{k-1}$ and $B_k(z)$, wherein m is an integer such that $V_m$ is equal to W, (iii) allowing the other player to select one of said $B_k(z)$ sets, (iv) in response to said selection by the other player, assigning to the current player any node in any of said maximal connected sets, other than said selected $B_k(z)$ set, that is not owned by the current player, and updating said playing field on said user interface to indicate the ownership status of the nodes.

35. A digital gaming system, comprising:

at least one user interface comprising a display for presenting a playing field comprising a plurality of nodes representing a square toroidal grid and at least two symbols for assigning ownership of each of said nodes to at least one of two players, said nodes being initialized as null nodes, said user interface being configured to receive input indicative of assignment of said symbols to said null nodes, at least one processor in communication with said at least one user interface, said processor being programmed to execute the following tasks in response to an input indicative of an assignment of one of said symbols to one of said null nodes to indicate ownership of that null node by one of the players ("current player"):

(A) identifying one or more sets of null nodes or nodes owned by the other player, that are bounded by nodes owned by the current player ("bounded sets"), (B) transferring ownership of one or more transferable bounded sets, if any, to the current player by assigning the symbol associated with the current player to nodes within said one or more transferable bounded sets, and (C) updating said display of the playing field to indicate current status of said plurality of nodes.

36. The digital gaming system of claim 35, wherein said display comprises a touch panel to allow providing input regarding assignment of said symbols to said null nodes via touching said panel.

37. The digital gaming system of claim 35, wherein said touch panel represents each node by a delineated area.

38. The digital gaming system of claim 35, wherein the at least one user interface comprises a plurality of user interfaces, each having a display for presenting the playing field.

39. The digital gaming system of claim 38, wherein the at least one processor comprises a digital processing unit associated with each of the plurality of user interfaces.

40. The digital gaming system of claim 38, wherein the processor is in communication with each of the plurality of user interfaces.

41. The digital gaming system of claim 35, wherein the at least one processor comprises at least two digital processing units, each of which is in communication with one of said plurality of user interfaces.

42. The digital gaming system of claim 41, wherein the at least two digital processing units are in communication with one another.

43. The digital gaming system of claim 42, wherein the at least two digital processing units are in communication with one another via a wireless network.

44. The digital gaming system of claim 42, wherein the at least two digital processing units are in communication with one another via the internet.

45. A digital gaming system of comprising:

at least one user interface comprising a display for presenting a playing field comprising a plurality of nodes and at least two symbols for assigning ownership of each of said nodes to at least one of two players, said nodes being initialized as null nodes, said user interface being configured to receive input indicative of assignment of said symbols to said null nodes, at least one processor in communication with said at least one user interface, said processor being programmed to execute the following tasks in response to an input indicative of an assignment of one of said symbols to one of said null nodes to indicate ownership of that null node by one of the players ("current player"):

(A) identifying one or more sets of null nodes or nodes owned by the other player that are bounded by nodes owned by the current player ("bounded sets"), (B) transferring ownership of one or more transferable bounded sets, if any, to the current player by assigning the symbol associated with the current player to nodes within said one or more transferable bounded sets, and (C) updating said display of the playing field to indicate current status of said plurality of nodes, wherein said at least one processor is programmed to execute said steps of identifying said bounded sets and transferring ownership of said one or more transferable bounded sets to the current player by performing the following steps:

(i) selecting a node (herein "node z") not owned by the current player, (ii) determining a maximal set of nodes not owned by the current player that contains said node z (herein "set B(z)"), (iii) determining a cardinality of the set B(z), (iv) determining a cardinality of a set of boundary nodes of B(z) (herein "set ∂B(z)"), and (v) if said cardinality of the set B(z) is less than one half of the total number of nodes, transferring ownership of the nodes in the set B(z) to the current player, or (vi) if a sum of said cardinality of the set B(z) plus said cardinality of the set ∂B(z) is greater than one half of the total number of nodes, transferring ownership to the current player of nodes in a set complementary to the set B(z) and not owned by the current player.

46. A digital gaming system comprising:

at least one user interface comprising a display for presenting a playing field comprising a plurality of nodes and at least two symbols for assigning ownership of each of said nodes to at least one of two players, said nodes being initialized as null nodes, said user interface being configured to receive input indicative of assignment of said symbols to said null nodes, at least one processor in communication with said at least one user interface, said processor being programmed to execute the following tasks in response to an input indicative of an assignment of one of said symbols to one of said null nodes to indicate ownership of that null node by one of the players ("current player"):

(A) identifying one or more sets of null nodes or nodes owned by the other player, that are bounded by nodes owned by the current player ("bounded sets"), (B) transferring ownership of one or more transferable bounded sets, if any, to the current player by assigning the symbol associated with the current player to nodes within said one or more transferable bounded sets, and (C) updating said display of the playing field to indicate current status of said plurality of nodes, wherein said at least one processor is programmed to execute said steps of identifying said one or more bounded sets and transferring ownership of said one or more transferable bounded sets to the current player by performing the following steps:

(i) selecting a node (herein "node z") not owned by the current player, (ii) identifying a maximal connected set B(z) associated with said node z (herein "set B(z)"), and (iii) if a cardinality of the set B(z) is less than half a total number of nodes of the playing field, assigning to the current player any nodes in the set B(z) not owned by the current player, or (iv) if a cardinality of the set B(z) is equal to or greater than half said total number of nodes, assigning to the current player any nodes in a complement set of the set B(z) not owned by current player.

47. A digital gaming system comprising:

at least one user interface comprising a display for presenting a playing field comprising a plurality of nodes and at least two symbols for assigning ownership of each of said nodes to at least one of two players, said nodes being initialized as null nodes, said user interface being configured to receive input indicative of assignment of said symbols to said null nodes, at least one processor in communication with said at least one user interface, said processor being programmed to execute the following tasks in response to an input indicative of an assignment of one of said symbols to one of said null nodes to indicate ownership of that null node by one of the players ("current player"):

(A) identifying one or more sets of null nodes or nodes owned by the other player that are bounded by nodes owned by the current player ("bounded sets"), (B) transferring ownership of one or more transferable bounded sets, if any, to the current player by assigning the symbol associated with the current player to nodes within said one or more transferable bounded sets, and (C) updating said display of the playing field to indicate current status of said plurality of nodes;

wherein the playing field comprises a subset of perimeter nodes (herein "set P"), and wherein said at least one processor is programmed to execute said steps of identifying said one or more bounded sets and transferring ownership of said one or more transferable bounded sets to the current player by performing the following steps:

(i) selecting a node (herein "node z") not owned by the current player, (ii) identifying a maximal connected set (herein "set B(z)") associated with said node z, and (iii) if a cardinality of a set corresponding to an intersection of the set B(z) and the set P is less than half of a cardinality of the set P, assigning to the current player any node in the set B(z) not owned by the current player, or (iv) if a cardinality of a set corresponding to an intersection of the set B(z) and the set P is equal to or greater than half of the cardinality of the set P, assigning to the current player any node in a complement set of the set B(z) not owned by the current player.

48. A digital gaming system comprising:

at least one user interface comprising a display for presenting a playing field comprising a plurality of nodes and at least two symbols for assigning ownership of each of said nodes to at least one of two players, said nodes being initialized as null nodes, said user interface being configured to receive input indicative of assignment of said symbols to said null nodes, at least one processor in communication with said at least one user interface, said processor being programmed to execute the following tasks in response to an input indicative of an assignment of one of said symbols to one of said null nodes to indicate ownership of that null node by one of the players ("current player"):

(A) identifying one or more sets of null nodes or nodes owned by the other player that are bounded by nodes owned by the current player ("bounded sets"), (B) transferring ownership of one or more transferable bounded sets, if any, to the current player by assigning the symbol associated with the current player to nodes within said one or more transferable bounded sets, and (C) updating said display of the playing field to indicate current status of said plurality of nodes, wherein the playing field comprises a set of nodes (herein "set W"), every node $n_i$ of which has a pre-determined number value $v_i$, and any subset of which has a cardinality equal to the sum of the associated values of the nodes it contains, and wherein said at least one processor is programmed to execute said steps of identifying said one or more bounded sets and transferring ownership of said one or more transferable bounded set to the current player by performing the following steps:

(i)defining a test set ($V_0$) as a set of nodes owned by the current player, (ii) for k=1 to m, iteratively performing the following steps:

(a) if $V_{k-1}$ is not equal to W, selecting a node $z_k$ not contained in the set $V_{k-1}$, (b) identifying a maximal connected set $B_k(z)$ associated with the node $z_k$, (c) defining a set $V_k$ as a union of $V_{k-1}$ and $B_k(z)$, wherein m is an integer such that $V_m$ is equal to W, (iii) if a cardinality of any maximal connected set $B_k(z)$ is less than half of a cardinality of W, assigning to the current player any nodes in the set $B_k(z)$ not owned by the current player.

49. A digital gaming system comprising:

at least one user interface comprising a display for presenting a playing field comprising a plurality of nodes and at least two symbols for assigning ownership of each of said nodes to at least one of two players, said nodes being initialized as null nodes, said user interface being configured to receive input indicative of assignment of said symbols to said null nodes, at least one processor in communication with said at least one user interface, said processor being programmed to execute the following tasks in response to an input indicative of an assignment of one of said symbols to one of said null nodes to indicate ownership of that null node by one of the players ("current player"):

(A) identifying one or more sets of null nodes or nodes owned by the other player, that are bounded by nodes owned by the current player ("bounded sets"), (B) transferring ownership of one or more transferable bounded sets, if any, to the current player by assigning the symbol associated with the current player to nodes within said one or more transferable bounded sets, and (C) updating said display of the playing field to indicate current status of said plurality of nodes, wherein the playing field comprises a set of nodes (herein "set W"), and wherein said at least one processor is programmed to execute said steps of identifying said one or more bounded sets and transferring ownership of said one or more transferable bounded sets to the current player by performing the following steps:

(i) defining a test set ($V_0$) as a set of nodes owned by the current player, (ii) for k=1 to m, iteratively performing the following steps:

(a) if $V_{k-1}$ is not equal to W, selecting a node $z_k$ not contained in the set $V_{k-1}$, (b) identifying a maximal connected set $B_k(z)$ associated with the node $z_k$, (c) defining a set $V_k$ as a union of $V_{k-1}$ and $B_k(z)$, wherein m is an integer such that $V_m$ is equal to W, (iii) identifying among the maximal connected sets $B_k(z)$ the set $B_{max}$ having a cardinality equal to or greater than a cardinality of any of the other maximal connected sets, and (iv) if a cardinality of $B_{max}$ is greater than a sum of cardinalities of the other maximal connected sets $B_k(z)$, assigning to the current player any node not in $B_{max}$ and not owned by the current player.

50. A digital gaming system comprising:

at least one user interface comprising a display for presenting a playing field comprising a plurality of nodes and at least two symbols for assigning ownership of each of said nodes to at least one of two players, said nodes being initialized as null nodes, said user interface being configured to receive input indicative of assignment of said symbols to said null nodes, at least one processor in communication with said at least one user interface, said processor being programmed to execute the following tasks in response to an input indicative of an assignment of one of said symbols to one of said null nodes to indicate ownership of that null node by one of the players ("current player"):

(A) identifying one or more sets of null nodes or nodes owned by the other player that are bounded by nodes owned by the current player ("bounded sets"), (B) transferring ownership of one or more transferable bounded sets, if any, to the current player by assigning the symbol associated with the current player to nodes within said one or more transferable bounded sets, and (C) updating said display of the playing field to indicate current status of said plurality of nodes, wherein the playing field comprises a set of nodes (herein "set W"), and wherein said at least one processor is programmed to execute said steps of identifying said one or more bounded sets and transferring ownership of said one or more transferable bounded set to the current player by performing the following steps:

(i) defining a test set ($V_0$) as a set of nodes owned by the current player, (ii) for k=1 to m, iteratively performing the following steps:

(a) if $V_{k-1}$ is not equal to W, selecting a node $z_k$ not contained in the set $V_{k-1}$, (b) identifying a maximal connected set $B_k(z)$ associated with the node $z_k$ (c) defining a set $V_k$ as a union of $V_{k-1}$ and $B_k(z)$, wherein m is an integer such that $V_m$ is equal to W, (iii) allowing the other player to select one of said $B_k(z)$ sets, (iv) in response to said selection by the other player, assigning to the current player any node in any of said $B_k(z)$ sets, other than said selected $B_k(z)$ set, that is not owned by the current player.

* * * * *